US008154844B2

(12) United States Patent
Brown

(10) Patent No.: US 8,154,844 B2
(45) Date of Patent: Apr. 10, 2012

(54) WEARABLE SHIELD AND SELF-DEFENSE DEVICE INCLUDING MULTIPLE INTEGRATED COMPONENTS

(75) Inventor: David C. Brown, Ladera Ranch, CA (US)

(73) Assignee: Armstar, Inc., Ladera Ranch, CA (US)

( * ) Notice: Subject to any disclaimer, the term of this patent is extended or adjusted under 35 U.S.C. 154(b) by 917 days.

(21) Appl. No.: 12/117,695

(22) Filed: May 8, 2008

(65) Prior Publication Data

US 2011/0013337 A1 Jan. 20, 2011

(51) Int. Cl.
*F42B 30/00* (2006.01)

(52) U.S. Cl. ..... 361/232; 102/502

(58) Field of Classification Search ..... 361/232; 42/1.08; 102/502

See application file for complete search history.

(56) References Cited

U.S. PATENT DOCUMENTS

| | | | | |
|---|---|---|---|---|
| 3,998,459 | A | 12/1976 | Henderson | |
| 4,370,696 | A | 1/1983 | Darrell | |
| 4,485,426 | A | 11/1984 | Kerls | |
| 4,557,275 | A | 12/1985 | Dempsey, Jr. | |
| 4,884,809 | A | 12/1989 | Rowan | |
| 4,945,811 | A | 8/1990 | Grieb | |
| 5,103,366 | A | 4/1992 | Battochi | |
| 5,193,048 | A | 3/1993 | Kaufman | |
| 5,282,481 | A | 2/1994 | Ziemer | |
| 5,546,844 | A | 8/1996 | Krumm | |
| 5,588,398 | A | 12/1996 | Allen | |
| 5,658,316 | A | 8/1997 | Lamond | |
| 5,698,815 | A | 12/1997 | Ragner | |
| 5,801,866 | A | 9/1998 | Chan | |
| 5,884,198 | A | 3/1999 | Kese | |
| 6,169,488 | B1 | 1/2001 | Ketler | |
| 6,211,672 | B1 | 4/2001 | Bauman | |
| 6,456,884 | B1 | 9/2002 | Kenney | |
| 6,646,855 | B2 | 11/2003 | Buening | |
| 6,870,089 | B1 | 3/2005 | Gray | |
| 6,876,302 | B1 | 4/2005 | Steeves | |
| 6,933,851 | B2 | 8/2005 | Hahne | |
| 6,961,227 | B1 | 11/2005 | Whiton | |
| 7,012,797 | B1 | 3/2006 | Delida | |
| 7,206,183 | B2 * | 4/2007 | Sikes et al. | 361/232 |
| 7,221,552 | B1 | 5/2007 | Brown | |
| 7,477,504 | B1 * | 1/2009 | Delida | 361/230 |
| 2002/0178485 | A1 | 12/2002 | Medves | |
| 2003/0056638 | A1 | 3/2003 | Poole | |
| 2003/0137795 | A1 | 7/2003 | Buening | |
| 2004/0154071 | A1 | 8/2004 | Frahm | |
| 2004/0264099 | A1 | 12/2004 | Sikes | |
| 2007/0207793 | A1 | 9/2007 | Myer et al. | |

OTHER PUBLICATIONS

International Search Report in PCT/US09/43026 issued on Mar. 3, 2010. International Preliminary Report on Patentability issued Nov. 9, 2010 in related PCT Appl. No. PCT/US2009/043026.
Written Opinion of the International Search Authority completed on Feb. 9, 2010 in related PCT Appl. No. PCT/US2009/043026.
International Search Report completed on Feb. 9, 2010, in related PCT Appl. No. PCT/US2009/043026.

* cited by examiner

*Primary Examiner* — Danny Nguyen
(74) *Attorney, Agent, or Firm* — Jeffer Mangels Butler & Mitchell LLP

(57) ABSTRACT

A personal defense device that includes a shield member configured to be worn over at least a third of a length of a user's forearm, the forearm being bounded by the user's ipsilateral wrist and ipsilateral elbow, the length being measured from the wrist to the elbow, the shield member conforming closely to the outer surface counters of a forearm, and a portable source of electricity. The shield member includes an electrical shock bar configured to receive an electrical current from the electrical source and to deliver an electrical shock to a human or other animal.

23 Claims, 21 Drawing Sheets

WEARABLE SHIELD AND SELF-DEFENSE DEVICE INCLUDING MULTIPLE INTEGRATED COMPONENTS

BACKGROUND

1. Field of the Invention

The present invention relates generally to a wearable shield and self-defense device and system, and more particularly, to a wearable shield and self-defense device and system that includes components for thwarting attackers.

2. Background of the Invention

Police, military, and other individuals use a wide variety of protective gear and lethal or less-lethal weapons to defend themselves from attacks. Police riot gear may include, for example, firearms, helmets, batons, hand-held shields, impact resistant or bullet proof vests, protective eye goggles, gas masks, and other devices configured to subdue an attacker or shield against a physical assault.

One type of less-lethal or non-lethal weapon is a hand-held electrical shock device or hand-held electrical stun weapon that delivers a high-voltage electrical shock through direct contact with electrodes that are either attached to a hand-held device or are projected by a hand-held gun with wires connected to the electrodes. Generally, the person or animal receiving an electrical shock from such a device is incapacitated for a period of time. However, like other hand-held weapons (both lethal and less-lethal), an attacker can easily separate a user from a conventional hand-held electrical shock device. For example, an attacker may grab or knock the hand-held electrical shock device away from the user, which might render the user defenseless. Further, the attacker may gain control of the hand-held electrical shock device and use it to incapacitate the original user.

Hand-held electrical shock devices are also difficult or inconvenient to use in conjunction with another weapon or when a user needs both hands free for other tasks. For example, a soldier or police officer will generally stow their hand-held electrical shock device in a holster or holder when not in use to allow them to perform such tasks as handle a fire arm, hold a hand-held shield, or frisk and handcuff a suspect. With the hand-held electrical shock device stowed, the user may not be able to retrieve it in time to defend against an attack.

Other electrical shock devices include a glove having electrodes positioned on the glove such that a user wearing the glove can shock an attacker by touching them with the electrodes. Such devices typically include an activation switch or contact on the glove to activate the electrodes. However, positioning the electrodes on the glove increases the risk that a person, animal or object being handled by the user will be inadvertently shocked. Further, placing the activation switch on the glove in close proximity to the electrodes increases this risk. In addition, conventional electrical shock gloves can generally be easily disabled or removed from a user by an attacker and do not provide impact or tamper resistant protection to the electrical circuitry of the device. Conventional electrical shock gloves also do not provide impact shielding to the user.

SUMMARY OF THE PREFERRED EMBODIMENTS

Thus, it would be advantageous to develop a wearable shield to protect a user from blunt force impact or being sliced or cut by a blade during a physical confrontation with an attacker. It would also be advantageous for the wearable shield to include an electrical shock device for personal protection that is resistant to being disabled or removed from the user by an attacker and is ready to be used even while the user's hands are occupied with other tasks. Further, it would be advantageous for the electrical shock device to provide an audible and/or visible warning to a potential attacker.

In one embodiment, a personal defense device includes a member configured to extend over at least a third of a length of a user's forearm. The forearm being bounded by the user's ipsilateral wrist and the user's ipsilateral elbow. The length measured from the ipsilateral wrist to the ipsilateral elbow. A plurality of electrical terminals extend from the member. A first pair of the plurality of electrical terminals is configured to deliver an electrical shock to a human or other animal. In certain such embodiments, the member is configured to house electrical circuitry located within the member. The electrical circuitry can be configured, for example, to convert a first voltage level to a second voltage level and to provide the second voltage level to at least the first pair of terminals. The second voltage level is higher than the second voltage level and is configured to disable, at least temporarily, the human or other animal.

In some embodiments, the member is configured to shield the forearm from an attacker and includes at least one of carbon fiber, Kevlar®, Dyneema, ballistic nylon, foam and gel. The member is configured to absorb and disperse an impact from an attacker. In certain embodiments, the member is configured to be bullet resistant and cut resistant. Some embodiments also include a pair of terminals configured to generate a spark that generates an electrical arcing noise in an audible range between about 60 decibels and about 100 decibels at a distance of about 1 meter.

In some embodiments, the personal defense device further includes a glove having a gauntlet portion comprising the member. The gauntlet portion is configured to extend above the user's elbow. The glove comprises one or more attachment devices configured to resist removal of the glove from the user by an attacker. Some embodiments also include a trigger attached to the glove, the trigger being user selectable to deliver a voltage to the plurality of electrical terminals. The trigger is attached below an outer surface of the palm of the glove. The personal defense device can also include an activation port configured to prevent the selective delivery of the electrical shock when a disarm pin is inserted therein, and to allow the selective delivery of the electrical shock when the disarm pin is removed from the activation port. The personal defense device may also include indicia of available power for the electrical shock.

In some embodiments, the electrodes are located on a saddle-shaped head attached to the member. In some embodiments, the personal defense device also includes an imaging device and the personal defense device is configured to transmit image data from the imaging device to a receiving station that receives and displays the image data. In some embodiments, the personal defense device also includes a global positioning device configured to transmit position data to a receiving station configured to receive and display the position data.

In some embodiments, the personal defense device includes a light source connected to the member. In some embodiments, the personal defense device includes an enclosure for housing one or more batteries and at least one solar panel connected to the enclosure, wherein the solar panels are configured to charge the batteries, and wherein the batteries are connectable to the member and configured to charge the member. In some embodiments, the personal defense device includes a siren connected to the member. In some embodiments, the personal defense device includes a solution, wherein the solution is configured to be projected from the member. The solution can be any solution used to defend or attack another person or animal, including, for example, pepper spray or tear gas. In some embodiments, the personal defense device includes a second member connectable to the electrical terminals for defibrillating a person in need of defibrillation.

In another embodiment, a method of defending oneself from an attacker includes wearing a member over a forearm and shocking the attacker with the member. In some embodiments, the member comprises a shield. The method may also include generating an electrical arcing noise from the member. The electrical arcing noise is configured to frighten the attacker. The method may also include transmitting data from the member to a receiving station. The data may include, for example, image data, audio data, physical data (such as biometric information) and/or location data. In some embodiments, the method also includes deflecting a blow from the attacker with the member.

In another embodiment, a personal defense device includes means for shielding a user's forearm from a physical attack and means for delivering an electrical shock from the means for shielding the user's forearm. In some embodiments, the means for shielding the user's arm is further configured to shield the means for delivering the electrical shock. In one embodiment, the personal defense device includes means for projecting a projectile. In one embodiment, the personal defense device includes means for defibrillating a person in need of defibrillation. In one embodiment, the personal defense device includes means for producing light. In one embodiment, the personal defense device includes means for charging, such as, for example, by a solar panel. In one embodiment, a solar panel is located on the personal defense device. In one embodiment, a solar panel is placed on a storage enclosure. In one embodiment, the personal defense device includes means for producing noise. In one embodiment, the personal defense device includes means for spraying a solution.

In accordance with an aspect of the present invention, there is provided a personal defense device that includes a shield member configured to be worn over at least a third of a length of a user's forearm, the forearm being bounded by the user's ipsilateral wrist and ipsilateral elbow, the length being measured from the wrist to the elbow, the shield member conforming closely to the outer surface counters of a forearm, and a portable source of electricity. The shield member includes an electrical shock bar configured to receive an electrical current from the electrical source and to deliver an electrical shock to a human or other animal. In an embodiment, the electrical shock bar includes a pair of substantially parallel shock bar members that are separated by an insulator and the electrical shock bar is configured to deliver an electrical shock when the electrical shock bar receives an electrical current from the electrical source and both of the shock bar members are contacted simultaneously.

In accordance with another aspect of the present invention, there is provided personal defense device that includes a shield member configured to be worn over at least a third of a length of a user's forearm, the forearm being bounded by the user's ipsilateral wrist and ipsilateral elbow, the length being measured from the wrist to the elbow, the shield member conforming closely to the outer surface counters of a forearm, a portable source of electricity, an imaging device, and a laser emitting device in alignment with the imaging device. The imaging device includes an image capture area, and the laser illuminates at least a portion of the image capture area. In a preferred embodiment, the personal defense device is configured to transmit image data from the imaging device to a receiving station, and the receiving station is configured to receive and display the image data. The personal defense device also includes a global positioning device in electrical communication with the imaging device and the global positioning device is configured to transmit position data from the global positioning device to the receiving station such that the location of the image capture area can be determined.

In accordance with another aspect of the present invention, there is provided a method that includes the step of providing a personal defense device that includes a shield member configured to be worn over at least a third of a length of a user's forearm, the forearm being bounded by the user's ipsilateral wrist and ipsilateral elbow, the length being measured from the wrist to the elbow, the shield member conforming closely to the outer surface counters of a forearm, a portable source of electricity, an imaging device, and a laser emitting device in alignment with the imaging device. The method also includes the steps of illuminating an area with the laser, and recording the illuminated area with the image capture device.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION

Figure 1:
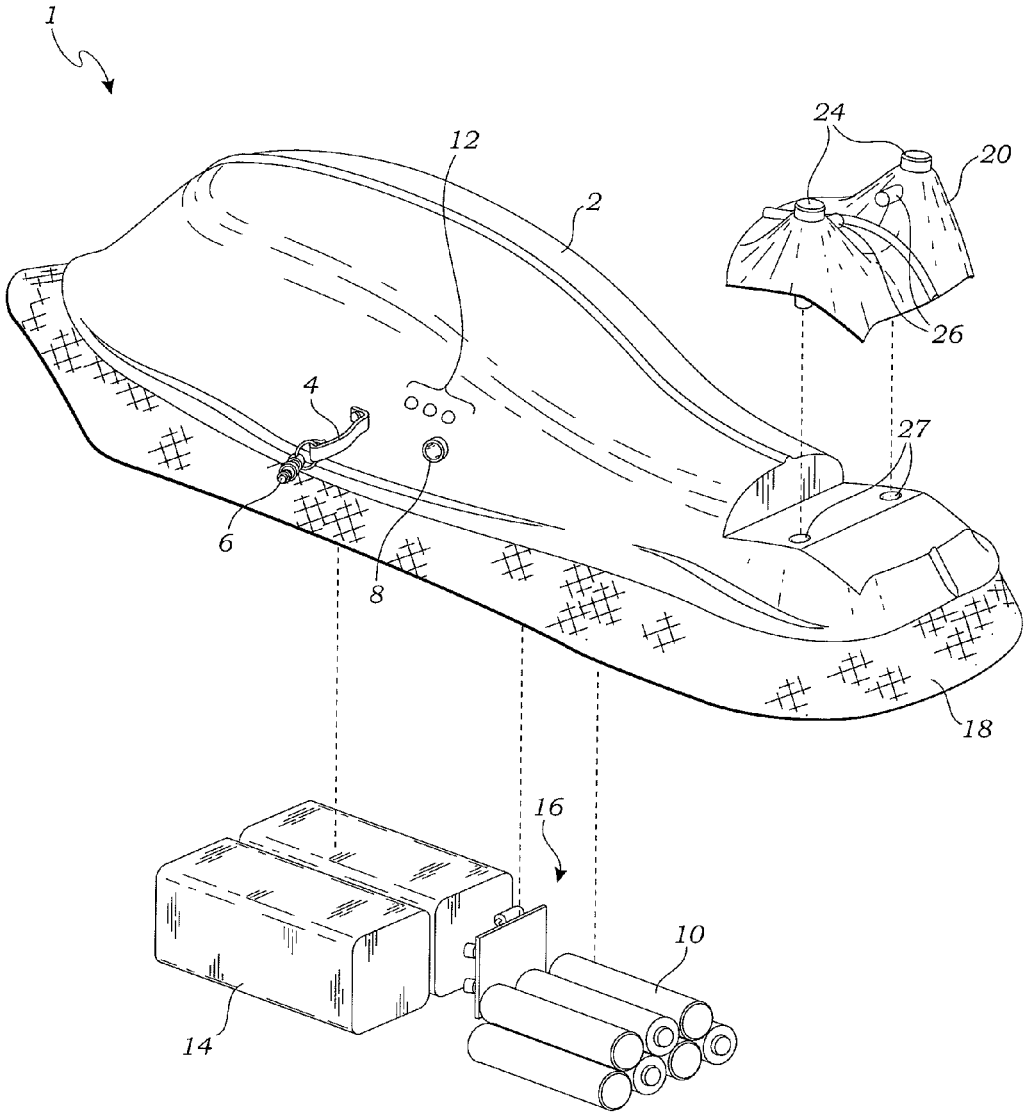
FIG. 1 is a perspective view of portions of an exemplary shield assembly configured to provide a shield and an electrical shock according to an embodiment of the invention.

The present disclosure relates to a wearable shield and electrical shock device for self defense.

It will be appreciated that terms such as "front," "back," "top," "bottom," "left," "right," "above," and "side" used herein are merely for ease of description and refer to the orientation of the components as shown in the figures. It should be understood that any orientation of the components described herein is within the scope of the present invention.

Embodiments of a personal defense device disclosed herein include an arm shield with an electrical shock device positioned thereon. The electrical shock device according to some embodiments includes a sparking device, a shock bar, and/or a device for the delivery of a less-lethal electric shock to an aggressor. The aggressor may be, for example, a human or animal. As used herein, the term "less-lethal" is a broad term having its ordinary and customary meaning and includes, for example, non-lethal force and force that is less likely to be lethal when compared to a gunshot wound, a stab wound, a blow from a blunt object, or the like. A less-lethal shock may be used for defensive purposes to disable an attacker without permanently injuring or killing the attacker. It is recognized, however, that some embodiments may be configured to have lethal consequences, at least for some targets.

The personal defense device can be worn while carrying or operating other weapons and offers an effective, less-lethal defensive aid for a user. The sparking device is visible and emits an electric arcing sound when activated to frighten a would-be attacker. The audible shocking sound, which can be emitted on demand, is unnerving and deters attackers. If the warning sound fails to deter the attack, a physical shock can be applied to the attacker, disabling the attacker and rendering the attacker unable to focus and carry out the attack. The attacker will either be rendered immobile, or will have ample reason and impulse to flee.

The wearable shield provides a defensive device that protects against blows from an attacker. The shield is impact-resistive and impact-dispersive so as to protect a user of the personal defense device as well as electric shock circuitry positioned beneath the shield. In certain embodiments, the electronics and the user's arm are further protected from blows by a solid foam or gel that surrounds the electronics within the shield. Thus, the shield works directly as a passive defense shield, when called upon for that purpose by the user. The shield is hard and strong and can also be used to hit an attacker. The shield is also lightweight and portable and can be worn comfortably for extended periods of time. In certain embodiments, the defensive device includes a shock bar that protects against an attacker grabbing the user's arm and/or controlling the device.

In certain embodiments, the shield includes straps for attaching the shield to a user's forearm or other body part. In other embodiments, the shield is attached to the gauntlet of a gauntlet glove such that it cannot be easily removed from a user wearing the glove by an attacker. In certain embodiments, the wearable shield is worn so as to be visually noticeable. In other certain embodiments, the wearable shield is concealed, such as, for example, under clothing or by altering its appearance to look like a natural part of an arm and/or hand, so that it is not readily noticeable. In some embodiments, the wearable shield is configured to be small enough to fit under the sleeve of a shirt in order to be concealed for use by, such as, for example, an air marshal, secret service member or an undercover police officer. In some embodiments, nano-technology is used to make the wearable shield small enough to fit under the sleeve of a shirt.

In the following description, reference is made to the accompanying drawings, which form a part hereof, and which show, by way of illustration, specific embodiments or processes in which the invention may be practiced. Where possible, the same reference numbers are used throughout the drawings to refer to the same or like components. In some instances, numerous specific details are set forth in order to provide a thorough understanding of the present disclosure. The present disclosure, however, may be practiced without the specific details or with certain alternative equivalent components and methods to those described herein. In other instances, well-known components and methods have not been described in detail so as not to unnecessarily obscure aspects of the present disclosure.

FIG. 1 is a perspective view of portions of an exemplary shield assembly 1 configured to provide a shield and an electrical shock according to an embodiment of the invention. The shield assembly 1 is configured to be worn over the forearm of a user and protects the user's forearm while allowing the user to electrically shock an animal or another person that comes in contact with the shield assembly 1. For illustrative purposes, the shield assembly 1 is shown partially disassembled. The shield assembly 1 includes a housing shield 2, a battery pack 10, a high voltage module 14, a battery state indicator module 16, and an arc head 20.

The housing shield 2 comprises a hard material configured to resist and disperse an impact force from, for example, an attacker. Suitable materials for the housing shield 2 include, for example, hard plastic polymers, metals, and metal alloys. In an exemplary embodiment, the housing shield 2 comprises a strong and lightweight material such as a carbon fiber composite. In addition, or in other embodiments, the housing shield 2 includes strong, light weight, flexible materials such as Kevlar® available from DuPont Advanced Fibers Systems of Richmond, Va., Dyneema, available from DSM Dyneema of Geleen, the Netherlands, MACRO-Lite, available from Boeing, Inc. and/or ballistic nylon to further resist and disperse impact forces and protect the user from bullets and other projectiles. As discussed in detail below, the housing shield 2 may also include a non-conductive foam and/or gel to absorb and disperse impact forces.

When assembled and in use, the battery pack 10, high voltage module 14, and battery state indicator module 16 are housed within the housing shield 2. The housing shield 2 is configured to protect the battery pack 10, the high voltage module 14, and the battery state indicator module 16 from impact forces and from tampering when worn on a user's forearm. Thus, it is difficult or impossible for an attacker, for example, to destroy or disable the shield assembly 1.

The arc head 20 includes a vertical set of electrically conductive terminals 24 configured to deliver a high voltage electrical shock to a person, animal or object that comes into contact with the vertical set of terminals 24. As shown in FIG. 1, in an embodiment, the arc head 20 is saddle shaped with the vertical set of terminals 24 located at opposite peaks of the saddle. The saddle shaped arc head 20 allows the vertical set of terminals to extend away from the housing shield 2 to facilitate contact with an attacker. In an embodiment, the vertical set of terminals 24 are separated from each other by a distance in a range between approximately 1.4 inches and approximately 1.6 inches. In certain such embodiments, the vertical set of terminals 24 are sufficiently spaced from one another so that they do not produce an electrical arc when provided with power from the high voltage module 14. In certain embodiments, the arc head comprises a small area so as to reduce the risk of accidental electrocution. In certain embodiments, the arc head 20 is made from a strong and durable material and construction such that it can withstand would be attacker's blows, as well as being strong enough for uses such as, for example, breaking a car window (e.g., to rescue someone from a burning car). The arc head 20 can be made from the same materials as housing shield 2 described above. Thus, the shield assembly 1, including arc head 20, can be used as a shield, a baton, an electrical stun device, as well as other useful tool.

In certain embodiments, the arc head 20 also includes a horizontal set of electrically conductive terminals 26 configured to produce an electrical arc when provided with power from the high voltage module 14. As shown in FIG. 1, in certain such embodiments, the horizontal set of terminals 26 extend horizontally from the peaks of the saddle shaped arc head 20 below the vertical set of terminals 24. In certain such embodiments, the horizontal set of terminals 26 are electrically connected to the respective vertical terminals 24 located in the same peak of the saddle shaped arc head 20. For example, the left horizontal terminal 26 is electrically connected to the left vertical terminal 24, and the right horizontal terminal 26 is electrically connected to the right vertical terminal 24.

The horizontal set of terminals 26 are spaced closer together than the vertical set of terminals 24 so as to generate an electrical arc that can be seen and/or heard by people or animals in the vicinity of a user of the shield assembly 1. In an embodiment, the horizontal set of terminals 26 are separated from each other by a distance in a range between approximately 0.3 inches and approximately 0.5 inches. The sight and/or arcing sound of the electrical arc generated between the horizontal terminals 26 is configured to frighten a would-be attacker. Thus, the would-be attacker may be scared away or scared into submission without having to actually electrically shock the would-be attacker. In one embodiment, the loudness of the arcing sound is in a range between approximately 65 decibels and approximately 75 decibels at a distance of approximately 1 meter. However, an artisan will recognize from the disclosure herein that the loudness of the arcing sound may be in other ranges and that the recognizable sight and/or sound of the electrical arc is generally sufficient to frighten a would-be attacker regardless of how loud it is.

The arc head 20 mounts as shown in FIG. 1 to mounting posts 27 on top of the housing shield 2. In another embodiment, the arc head 20 is mounted through an opening (not shown) in the housing shield 2 from below and is snapped into place such that the arc head 20 cannot be pulled from the housing shield 2 by an attacker. The arc head 20 is configured to electrically insulate the terminals 24, 26 from the housing shield 2. Thus, the arc head protects electrical circuitry within the housing shield 2 and the user from an electrical shock produced by the terminals 24, 26. Suitable materials for the arc head 20 include, for example, highly durable plastic polymers or other hard, non-conductive materials.

The housing shield 2 includes a disarm pin 6 attached to the housing shield 2 by a retainer strap 4. The housing shield 2 also includes an activation port 8, and one or more light emitting diodes (LEDs) 12 configured to indicate the status of the battery pack 10. In one embodiment, the LEDs 12 are mounted on one side of the housing shield 2 near the disarm pin 6 and activation port 8. As shown in FIG. 1, in one embodiment, there are at least three LEDs 12, at least one of which is lit when the shield assembly 1 is active (as discussed below) such that a shock can be delivered.

In an exemplary embodiment, the three LEDs 12 are red, yellow and green. The green light is lit when the battery pack 10 is amply charged. The yellow light is lit when the battery pack 10 needs charging. The red light is lit when the battery pack 10 is critically discharged. If none of the LEDs 12 are lit when the shield assembly 1 is activated (as discussed below) the battery pack 10 is discharged such that it can provide little or no power and should be recharged. Alternatively, if replaceable, the discharged battery pack 10 can be replaced with a freshly charged pack. An artisan will recognize from the disclosure herein that more or less LEDs can be used (e.g., one multi-colored light can be used), or that a digital or analog power meter could be used instead of the LEDs 12. Further, an artisan will recognize that any color or color combination can be used for the LEDs 12.

The battery pack 10 includes one or more batteries (seven shown) and provides power to electrical circuitry of the shield assembly 1, including the high voltage module 14, the arc head 20, the LEDs 12, and the battery state indicator module 16. In one embodiment, the battery pack 10 includes one or more rechargeable batteries that can be recharged by connecting an external power charger (not shown) to the activation port 8 to initiate a recharge sequence for the battery pack 10. The battery state indicator module 16 is configured to measure the relative charge remaining in the battery pack 10 and drive the LEDs 12 as discussed above. The high voltage module 14 is configured to convert a relatively low voltage from the battery pack 10 to a relatively high voltage provided to the terminals 24, 26 of the arc head 20 (and/or the shock bar 56 described below and shown in FIG. 11). For example, in one embodiment, the high voltage module 14 converts a first voltage in a range between approximately 9 V and approximately 27 V to a second voltage in a range between approximately 20,000 V and 150,000 V. In other embodiments, the second voltage is in a range between approximately 300,000 V and approximately 1,000,000 V. In other embodiments, the second voltage is in a range between approximately 650,000 V and approximately 850,000 V. In other embodiments, the second voltage is in a range between approximately 150,000 V and approximately 300,000 V. In still other embodiments, the second voltage is in a range between approximately 1 V and 20,000 V. Of course, a person of ordinary skill in the art will recognize that any non-lethal or lethal voltage range may be used with the devices of the present disclosure. The specified ranges are given by way of example and not limitation.

The disarm pin 6 is configured to be removably inserted into the activation port 8. The shield assembly 1 is activated or armed when the disarm pin 6 is removed from the activation port 8. With the disarm pin 6 removed, the high voltage module 14 can provide power to the terminals 24, 26 on the arc head 20 (and/or the shock bar 56 described below and shown in FIG. 11). In one embodiment, power is provided to the terminals 24, 26 and/or the shock bar 56 when the disarm pin 6 is removed from the activation port 8 and a user controlled trigger (not shown) is also activated. Thus, a user can activate the shield assembly 1 when desired by pulling the disarm pin 6 from the activation port 8 and then fire the weapon when desired using the trigger to deliver an electrical shock through the terminals 24, 26 and/or the shock bar 56. The trigger can be located, for example, on or near the shield assembly 1. In some embodiments, the trigger is located on a glove attached to the shield assembly 1. As discussed in more detail below, in some embodiments, the trigger is located in the palm of a glove attached to the shield assembly 1.

The shield assembly 1 is deactivated or disarmed when the disarm pin 6 is inserted into the activation port 8. Thus, an attacker could not disarm the shield assembly 1 by yanking on the retainer strap 4 or otherwise attempting to pull the disarm pin 6 from the activation port 8 (which would activate the shield assembly 1). When disarmed, power is not provided from the high voltage module 14 to the terminals 24, 26 on the arc head 20 and/or the shock bar 56. In one embodiment, a friction pressure fit between the disarm pin 6 and the activation port 8 prevents or reduces inadvertent removal of the disarm pin 6 from the activation port 8.

FIG. 1 also illustrates an apron 18 attached around the lower edge of the housing shield 2. As discussed below, the apron 18 is used in accordance with one embodiment to mount the housing shield 2 to an arm gauntlet of a gauntlet style glove. In certain such embodiments, the housing shield 2 comprises a carbon fiber composite material and the apron 18 comprises a strong and flexible material that is bound between carbon fiber layers from which it extends. The apron 18 can be inserted between fabric layers of the glove's arm gauntlet and attached thereto, such as, for example, by sewing, glue, radio frequency or sonic welding or any other suitable attachment methods. Suitable materials for the apron include, for example, Kevlar®, Dyneema, or other sewable materials that are light weight, high impact resistant, and highly durable.

Figure 2:
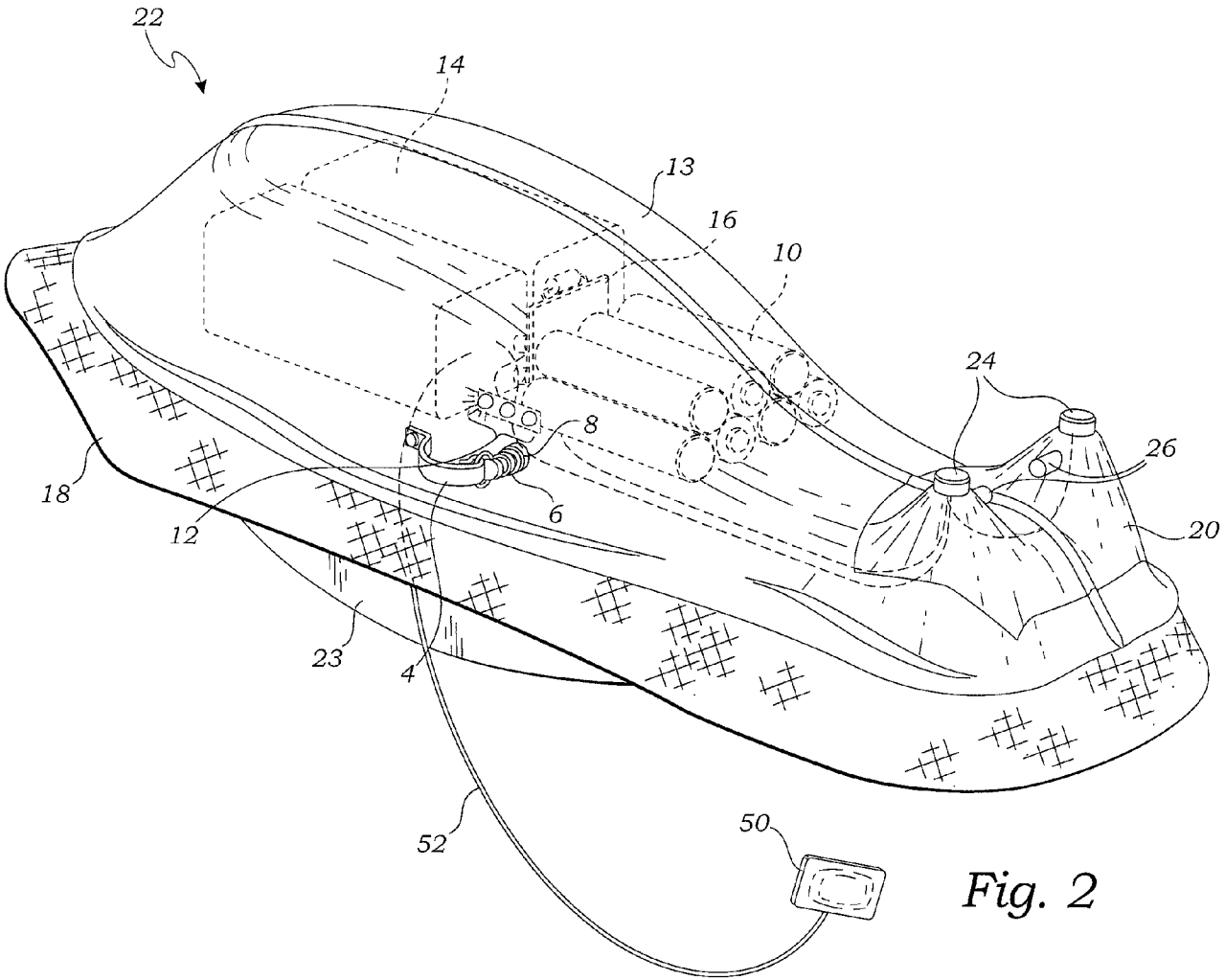
FIG. 2 is a perspective view of portions of an exemplary shield assembly configured to provide a shield and an electrical shock according to another embodiment of the invention.

FIG. 2 is a perspective view of portions of an exemplary shield assembly 22 configured to provide a shield and an electrical shock according to another embodiment of the invention. Unlike the shield assembly 1 shown in FIG. 1, the shield assembly 22 shown in FIG. 2 includes a housing shield 13 having an extended portion 23 configured to cover the side of a user's forearm. Thus, the top and side of the user's forearm are shielded while allowing the user to electrically shock an animal or another person that comes in contact with the arc head 20. The extended portion 23 is shown and discussed in greater detail in relation to FIGS. 9-12 below.

Suitable materials for the housing shield 13 and extended portion 23 include, for example, hard plastics, metals, and metal alloys. In an exemplary embodiment, the housing shield 13 and extended portion 23 comprise a strong and lightweight material such as a carbon fiber composite. In addition, or in other embodiments, the housing shield 13 includes strong, light-weight, flexible materials such as Kevlar®, Dyneema, MACRO-Lite and/or ballistic nylon to further resist and disperse impact forces and provide the ability to stop most bullets. As discussed in detail below, the housing shield 13 may also include a foam and/or gel to absorb and disperse impact forces.

In another embodiment, the housing shield 13 and arc head 20 are made of the same material and/or are a unitary component. In other words, the arc head is not mounted on posts, but is molded/created at the same time as the remainder of the housing shield 13. In such an embodiment, it is preferable that the material used to make the housing shield 13 and arc head 20 is non-conductive, to protect the wearer from the electrical arcs/shocks created by the terminals, but that the material is strong enough to resist impact forces, stop bullets, break windows, etc. An exemplary material is MACRO-Lite, as mentioned above.

For illustrative purposes, the battery pack 10, the high voltage module 14, and the battery state indicator module 16 discussed above are shown with dashed lines positioned beneath the housing shield 13. Also, the arc head 20 discussed above is shown attached to the housing shield 13.

As shown in FIG. 2, the shield assembly 22 includes a trigger button 50 configured to actuate a high-voltage stun shock to an attacker when the shield assembly 22 is activated. Electricity is run to the trigger button 50 via wire 52 to fire the stun device. In an embodiment, the wire 52 runs along the length of, and inside the housing shield 13 before exiting at the front of the housing shield 13 to a location on or near the hand of the user. As discussed in more detail below, in one embodiment, the trigger button 50 is sewn into the palm of a user's glove. When the trigger button 50 is pressed, an internal switch is closed so as to provide power from the high voltage module 14 to the terminals 24, 26 of the arc head 20 and/or the shock bar 56.

Figure 3:
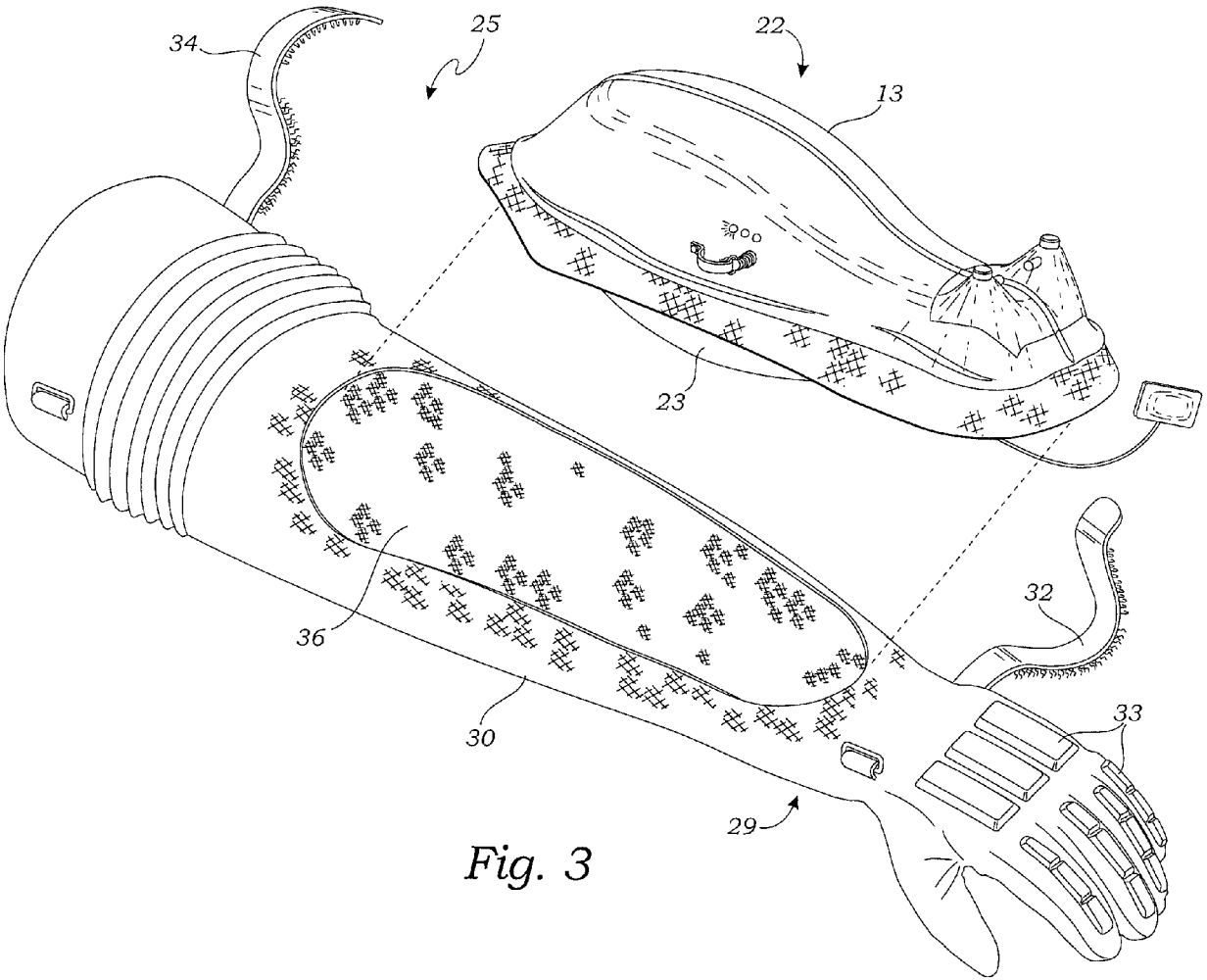
FIG. 3 is a perspective view of a partially disassembled personal defense device including an exemplary gauntlet style glove and the shield assembly of FIG. 2 according to an embodiment of the invention.

FIG. 3 is a perspective view of a partially disassembled personal defense device 25 including an exemplary gauntlet style glove 29 and the shield assembly 22 of FIG. 2 according to an embodiment of the invention. The glove 29 includes an arm gauntlet 30 with an attachment area 36 sized, positioned and configured to be attached to the shield assembly 22. While the attachment area 36 can be comprised of a hard material, such as a metallic or ceramic plate, in an embodiment, the attachment area 36 advantageously comprises a softer, cushioning, impact-dispersive material such as foam. The impact dispersive material of the attachment area 36 reduces the risk of injury to the user or damage to the electronics from blows to the housing shield 13 sustained from an attacker.

In certain embodiments, the personal defense device 25 includes one or more hand protection devices 33 attached to the glove 29 so as to be over the back of the user's hand and/or fingers. The hand protection devices 33 comprise a rigid material such as metal or hard plastic and are configured to protect the user's hand from impact forces. An artisan will recognize from the disclosure herein that other types and styles of gloves can also be used. For example, the glove 29 may comprise a light-weight exercise glove that extends to approximately the user's mid-forearm region. In certain such embodiments, the glove 29 does not include hand protection devices 33 and may be fingerless. In addition, or in other embodiments, the housing shield 13 is smaller, lighter, and has a lower profile than that shown in FIG. 3. Thus, the personal defense device 25 can be used during exercise or other physical activities where less weight and a smaller profile are desired, such as walking a dog at night or hiking in the wilderness.

Although it is possible to make an embodiment wherein the housing shield 13 is removable from the attachment area 36, in an embodiment, the housing shield 13 is substantially permanently attached to the material. A removable attachment, such as zipper or hook-and-loop material, is likely to be damaged during an attack. This could dislodge the housing shield 13 from the arm gauntlet 30, with potentially adverse consequences to the user of the shield assembly 22.

The glove 29 also includes two attachment straps, a front strap 32 and a rear strap 34. These straps 32, 34 are used to secure the arm gauntlet 30, with attached housing shield and internal components, to the arm of the user. In use, a user slips a hand into the glove 29, positions the forearm correctly and comfortably within the arm gauntlet 30, and tightens the front strap 32 and rear strap 34.

Figure 4:
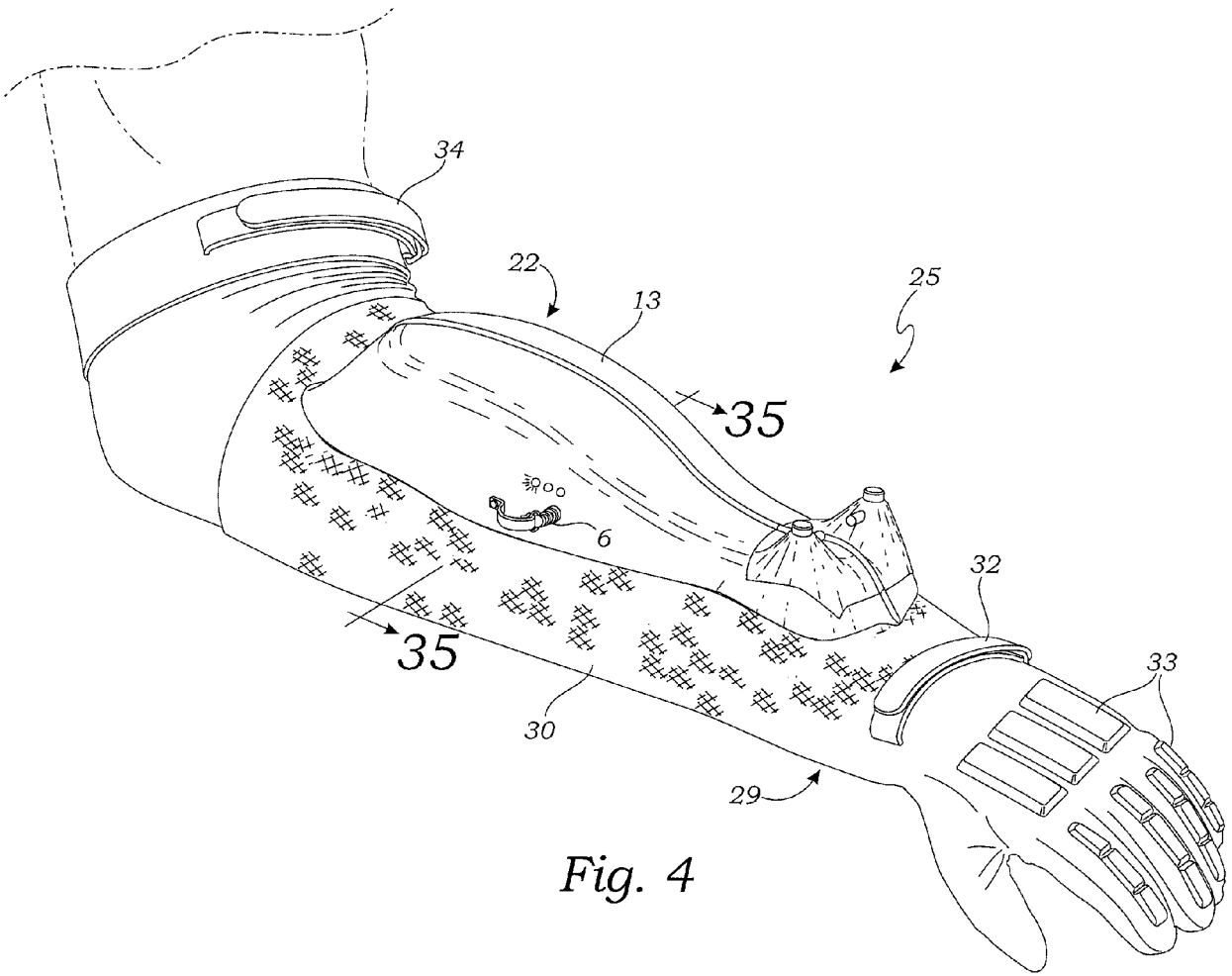
FIG. 4 is a perspective view of the personal defense device of FIG. 3 according to an embodiment of the invention.

FIG. 4 is a perspective view of the personal defense device 25 according to an embodiment of the invention. In FIG. 4, the personal defense device 25 is illustrated with the shield assembly 22 of FIG. 2 attached to the arm gauntlet 30 of the glove 29 shown in FIG. 3. In one embodiment, as illustrated in FIG. 4, the front strap 32 is configured to adjust the fit of the glove 29 around the user's wrist and the rear strap 34 is configured to adjust the fit of the glove 29 above or near the user's elbow. Thus, it would be difficult for an attacker to remove the glove 29 with the shield assembly 22 from the user during an attack. Although not shown, in certain embodiments, the glove 29 extends to approximately the middle of the user's bicep.

The housing shield 13 covers a substantial portion of the user's forearm. In some embodiments, the housing shield 13 covers at least a third of the user's forearm. In other embodiments, the housing shield 13 covers between approximately 50% and approximately 95% of the top of the user's forearm. In other embodiments, the housing shield 13 covers between approximately 20% and approximately 50% of the top of the user's forearm. In other embodiments, the housing shield 13 covers substantially the entire top of the user's forearm and may extend above the elbow and/or below the wrist. In certain embodiments, the housing shield 13 extends over at least a portion of the user's wrist to protect the wrist from impact forces. In addition, or in other embodiments, the housing shield 13 extends over the sides of the user's forearm. In certain such embodiments, the housing shield 13 extends substantially all the way around the user's forearm to protect all sides of the forearm from impact forces.

Figure 5:
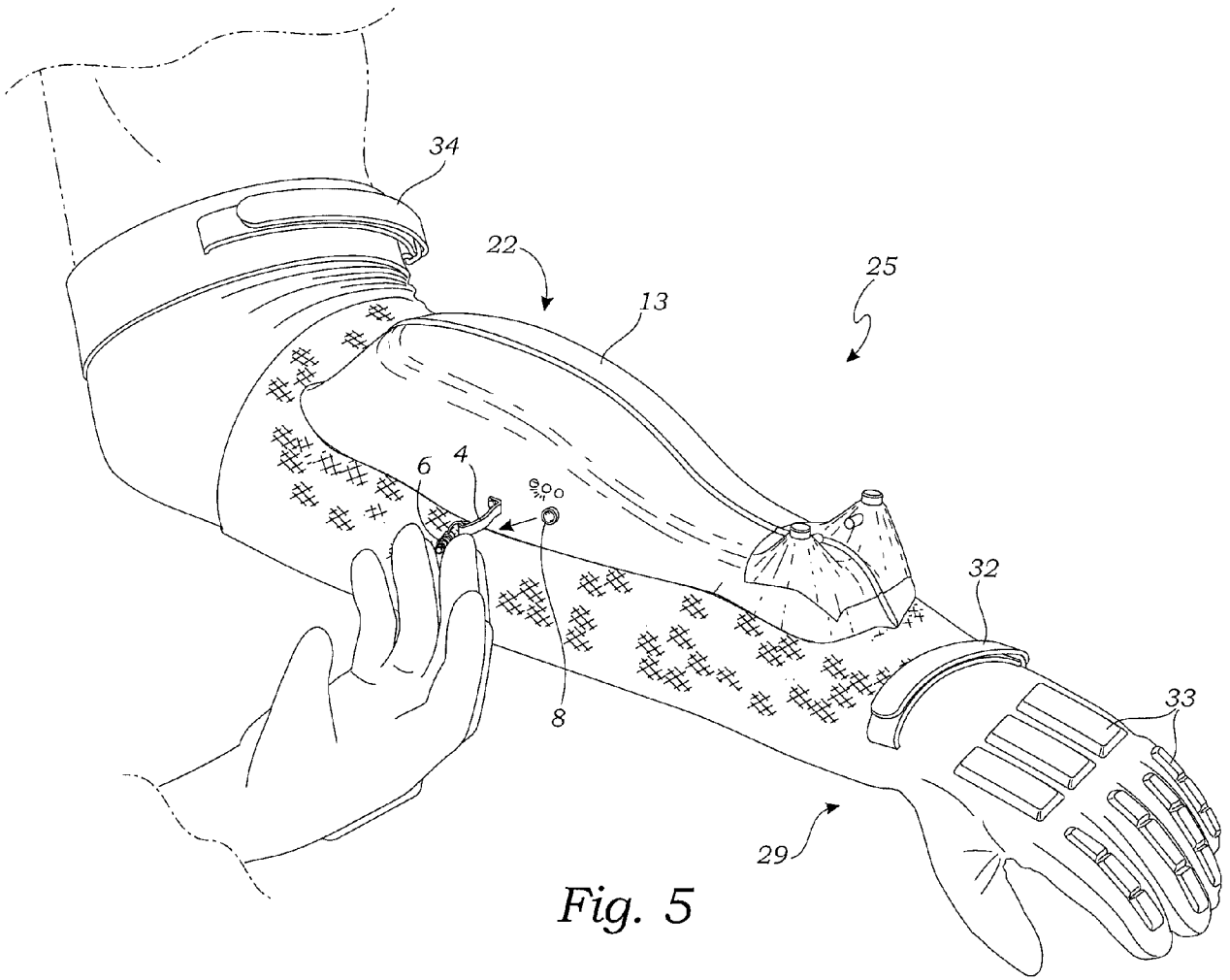
FIG. 5 is a perspective view of the personal defense device of FIG. 3 being activated by a user according to an embodiment of the invention.

As shown in FIG. 4, the shield assembly 22 is attached to the glove 29, charged, and ready for use simply by removing the disarm pin 6. FIG. 5 is a perspective view of the personal defense device 25 of FIG. 4 being activated by a user according to an embodiment of the invention. The operator activates the personal defense device 25 by removing the disarm pin 6 from the activation port 8 of the shield assembly 22. The trigger button 50 (shown in FIG. 2) will now be "live" and ready to use upon user command.

Figure 6:
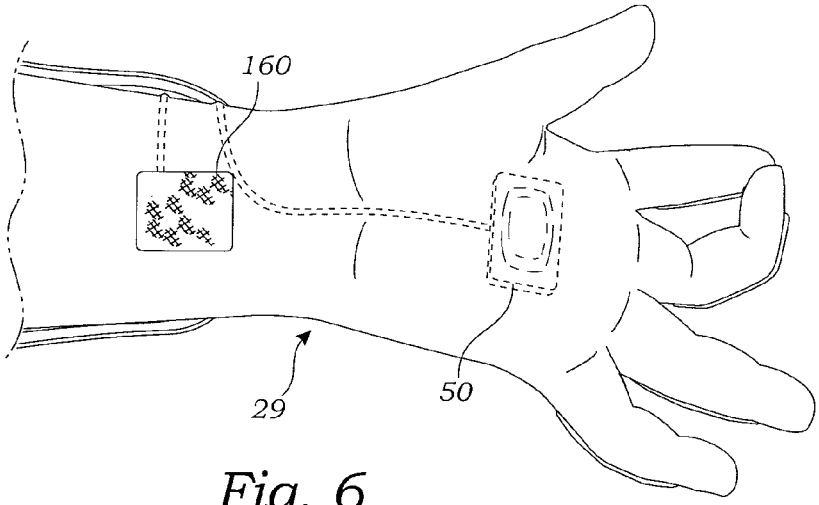
FIG. 6 illustrates a trigger button positioned in the palm of a user's hand for delivering an electrical shock according to an embodiment of the invention.

FIG. 6 illustrates the trigger button 50 positioned in the palm of a user's hand for delivering an electrical shock according to an embodiment of the invention. In one embodiment, the trigger button 50 is sewn into the palm of the glove 29 shown in FIGS. 3 5. In certain such embodiments, the trigger button 50 is concealed below the outer surface of the glove 29 so it is protected and so that its location is not known to an attacker. In other embodiments, the trigger button 50 is attached to the outer surface of the glove 29. In an embodiment, the trigger button 50 is a pressure-sensitive button. When the trigger button 50 is pressed, for instance, during confrontation with an aggressor, a high-voltage, less-lethal shock is delivered to the terminals 24, 26 of the arc head 20 and/or the shock bar 56.

Figure 7:
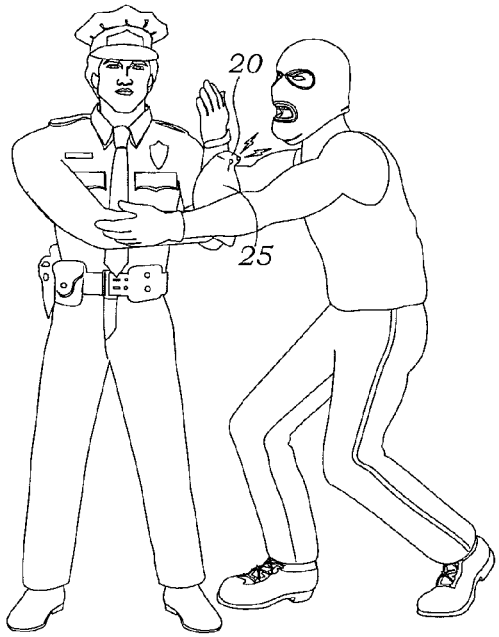
FIG. 7 illustrates an exemplary use of the personal defense device by a police officer in subduing an attacker according to an embodiment of the invention.

FIG. 7 illustrates an exemplary use of the personal defense device 25 by a police officer in subduing an attacker according to an embodiment of the invention. In this example, the police officer is wearing the personal defense device 25 on his left arm. The attacker has grabbed the officer's right arm, intending to prevent the officer from reaching his service weapon. The attacker had not anticipated the officer's use of the personal defense device 25, and is seen in the figure in the process of receiving an electrical shock administered from the shock terminals of the arc head 20. This example demonstrates the officer's ability to conduct normal duties, such as pat down or apply handcuffs to a suspect, unobstructed while armed with the personal defense device 25.

Figure 8:
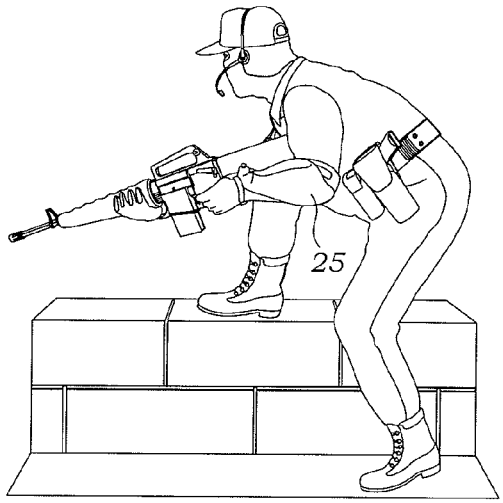
FIG. 8 illustrates a use of the personal defense device by a police officer carrying a firearm.

FIG. 8 illustrates another exemplary use of the personal defense device 25 by a police officer carrying a firearm. In this example, the police officer, possibly a member of a Special Weapons and Tactics (SWAT) team, takes position while armed with an assault rifle for active and long-range attack. The officer is wearing the personal defense device 25 on his left arm for close quarters combat. Thus, the officer is equipped to respond to deadly force threats using his rifle, and to respond to severe but less-lethal close proximity force with the personal defense device 25. The personal defense device 25 offers an important tool for users who are under increasing scrutiny for using deadly force to respond to situations that may not require the use of deadly force. This type of situation, which occurs all too frequently, can be avoided if a suitable attacker control device, such as, the personal defense device 25 is available for the user.

Figure 9:
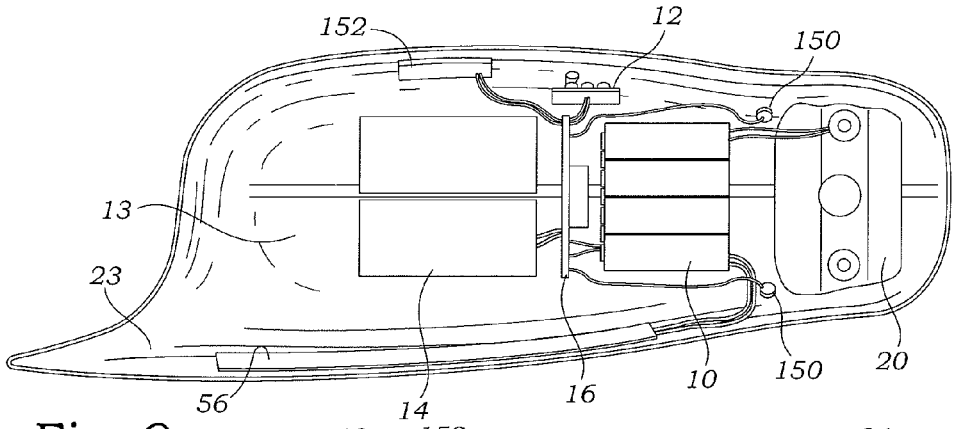
FIG. 9 is a bottom view of the housing shield that includes a shock bar in accordance with another embodiment of the invention.

FIGS. 9-12 show a bottom view of another embodiment of a housing shield 13. FIG. 9 is a bottom view of the housing shield 13 (which is similar to FIG. 2, but includes more components, as described below). For illustrative purposes, the apron 18 is not shown in FIGS. 9-12 and the battery pack 10, the battery state indicator module 16, the high voltage module 14 and the arc head 20 are shown on the interior of the housing shield 13 in FIG. 9. The housing shield 13 includes the extended portion 23 configured to shield the front or outside portion of the forearm. As discussed above, in certain embodiments, the arc head 20 (shown from below in FIG. 9) is mounted through an opening in the housing shield 2 from below and is snapped into place such that the arc head 20 cannot be pulled from the housing shield 2 by an attacker from above.

As shown in FIGS. 9-12, in certain embodiments of the present invention, the housing shield 13 can include a shock bar 56. Preferably, the shock bar 56 is located on the outside of the housing shield 13 (corresponding to the outer portion of a user's arm) and is elongated such that it extends along a significant portion of the housing shield 13. However, this is not a limitation on the present invention. In a preferred embodiment, the shock bar 56 extends along at least a third of the length of the housing shield 13. In other embodiments, the shock bar 56 can extend along less than a third of the entire length of the housing shield 13 or more than half of the length of the housing shield. However, these figures are not a limitation on the present invention. The shock bar 56 can be operated by the trigger 50 or may have a separate trigger mechanism or switch for activation thereof.

Figure 11:
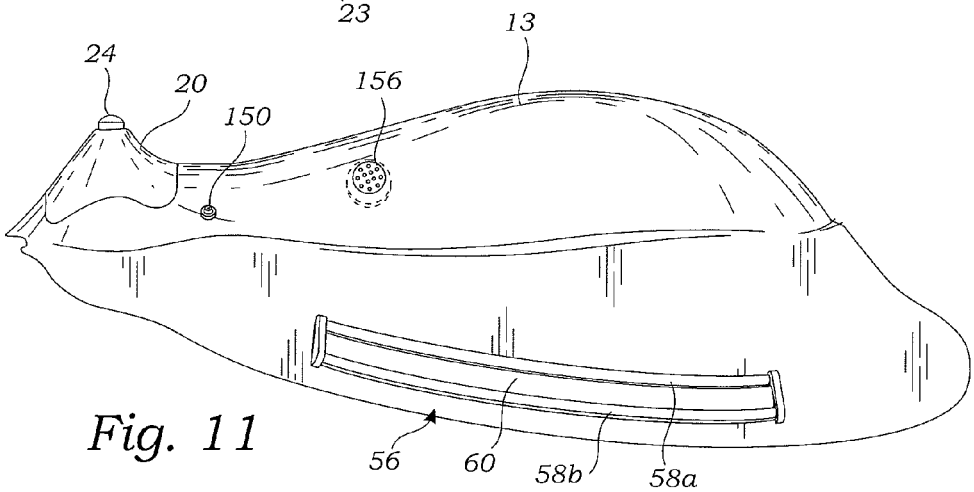
FIG. 11 is a right side view of the housing shield of FIG. 9.

As is best shown in FIG. 11, in an embodiment, the shock bar 56 includes a pair of shock bar members 58 (sometimes referred to herein as upper and lower shock members 58*a* and 58*b*), which are made of an electrically conductive material, such as metal. As shown in FIG. 11, the shock bar members 58 are separated by an insulation member 60 (a non-conductive member), such as an elongated piece of rubber or the like. In an embodiment, the shock bar members 58 are separated from each other by a distance in a range between approximately 1.4 inches and approximately 1.6 inches. However, the shock bar members 58 can be any distance apart. In certain such embodiments, the shock bar members 58 are sufficiently spaced from one another so that they do not produce an electrical arc when provided with power from the high voltage module 14. For example, the shock bar members 58 are spaced further apart than the horizontal set of terminals 26, so that the horizontal set of terminals 26 generate an electrical arc and not the shock bar members 58.

As shown in FIG. 9, and as described above, in a preferred embodiment, the shock bar 56 is in electrical communication with the battery pack 10. However, in another embodiment, the shock bar 56 can include its own power source, separate from the other sets of terminals 24, 26.

Figure 10:
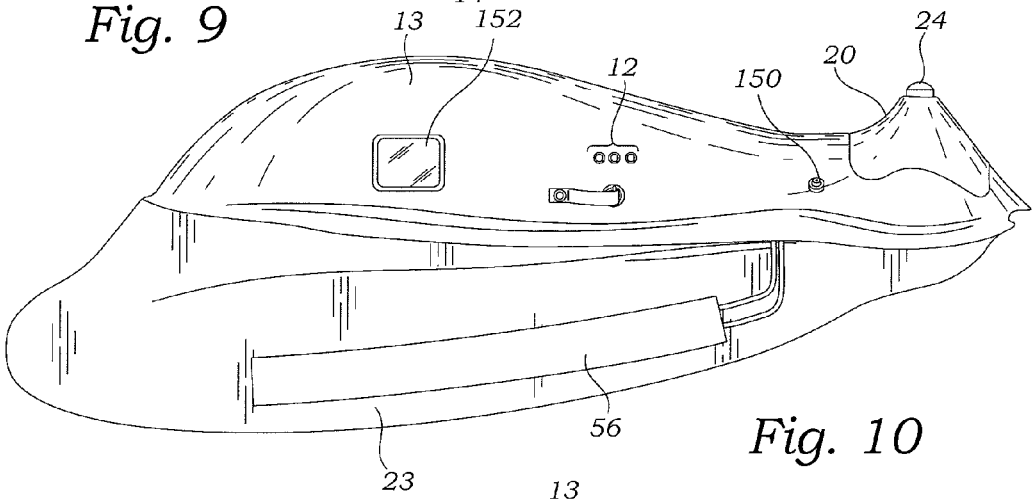
FIG. 10 is a right side view of the housing shield of FIG. 9.

As shown in FIG. 10, the shock bar 56 is mounted in a window defined in the housing shield 13. Preferably, the shock bar 56 is substantially flush with the outside surface of the housing shield 13. It will be understood that "substantially flush" means that the shock bar 56 (and, in particular, the shock bar members 58) can be slightly raised or slightly inset from the outside surface of the housing shield 13. For example, the shock bar 56 may be raised from the outside surface of the housing shield 13 by about 0.25" or less. With this configuration, the shock bar 56 will typically only be activated when a person grabs the arm of the wearer and contacts the shock bar 56 (in particular, the shock bar members 58). The fact that the shock bar 56 is relatively low profile prevents the shock bar 56 from getting in the way during normal use. The insulative properties of the housing shield 13 and the gauntlet, etc. protect the wearer from being shocked by the shock bar 56.

In the embodiment described above where the housing shield 13 and arc head 20 are made of a strong, non-conductive material, the shock bar members 58*a* and 58*b* can be molded into the housing shield 13 without the need for a separate non-conductive insulation member 60. Instead the material of the housing shield 13 that separates the shock bar members 58*a* and 58*b* acts as an insulation member.

Essentially, the shock bar 56 is a portion of the circuit that is open to the outside of the housing shield 13, thereby allowing anyone touching the shock bar 56 to be shocked and providing an extra element of protection to the wearer of the personal defense device 25. As discussed above, the shock is preferably less than lethal.

Figure 13:
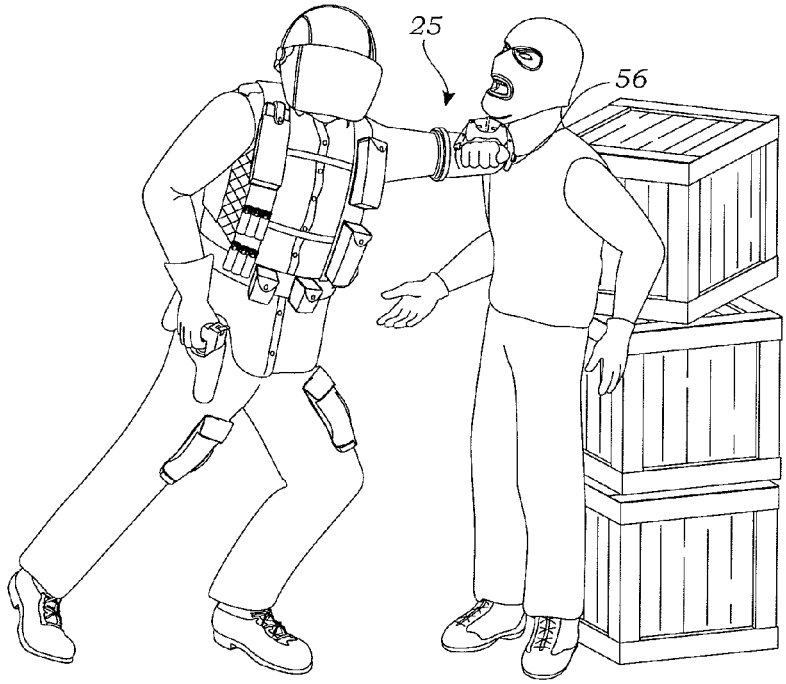
FIG. 13 illustrates an exemplary use of the personal defense device by a police officer in subduing an attacker according to an embodiment of the invention.

FIG. 13 illustrates an exemplary use of the personal defense device 25 by a police officer in subduing an attacker according to an embodiment of the invention. In this example, the police officer is wearing the personal defense device 25 on his left arm and has placed the shock bar 56 against the attacker's neck and has subdued the attacker by threatening to activate the shock bar.

Figure 15:
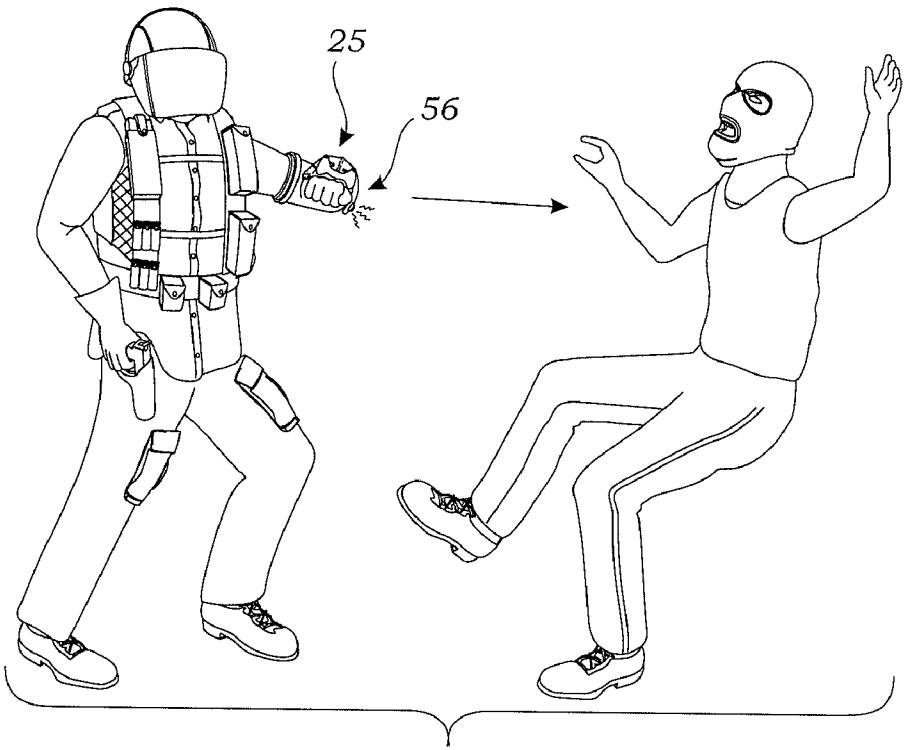
FIG. 15 illustrates the attacker of FIG. 14 after he has been shocked by the shock bar.
Figure 14:
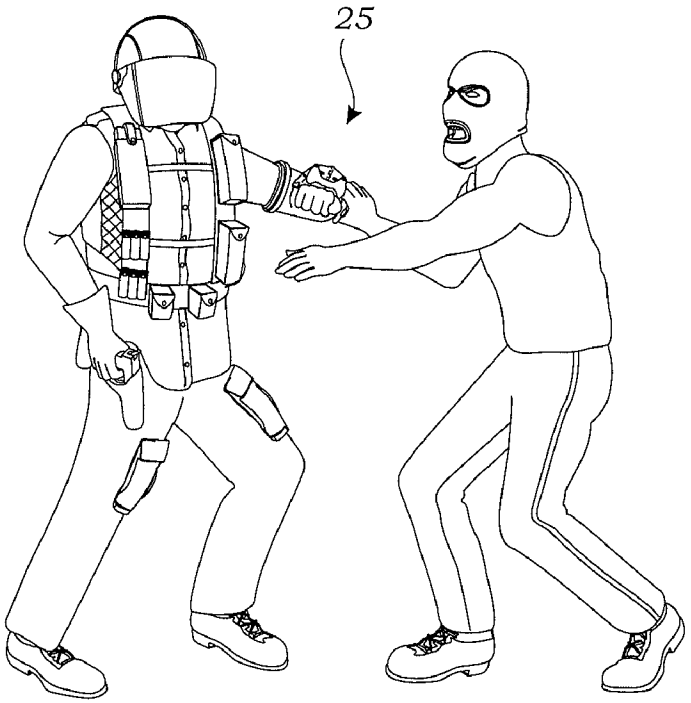
FIG. 14 illustrates another exemplary use of the personal defense device where an attacker grabs a police officer's arm and is shocked by the shock bar according to an embodiment of the invention.

FIGS. 14-15 illustrates another exemplary use of the personal defense device 25 by a police officer in subduing an attacker according to an embodiment of the invention. In this example, in FIG. 14, the attacker has grabbed the officer's left arm, intending to harm the officer or prevent the officer from reaching his service weapon. The attacker had not anticipated the officer's use of the personal defense device 25, and is seen in FIG. 15 in the process of receiving an electrical shock administered from the shock bar 56. This example demonstrates the officer's ability to prevent an attacker from gaining the upper hand from grabbing the officer's arm and to prevent an attacker from removing the personal defense device 25 from the officer's arm. Because the shock bar 56 extends along a significant portion of the housing shield 13, there is very little to no area where an attacker can grab the housing shield 13 without being shocked.

In one embodiment, the shock bar 56 and terminals 24, 26 can be in separate circuits and activated separately (by different triggers or switches). In another embodiment, as discussed above, they can be in the same circuit. In another embodiment, the shock bar 56 can be configured to activate automatically if both the positive and negative shock bar members 58*a* and 58*b* are contacted (thereby closing a circuit). Or, a pressure switch associated with the shock bar can cause its activation. This can help prevent a surprise attack.

FIG. 10 is a left side view of the housing shield 13 of FIG. 9. Quite visible in this view is the distinctive curve of the upper surface of housing shield 2, and the peak at the electrodes of arc head 20. Also visible in this view is the underside of the extended portion 23 of the housing shield 13, which includes the shock bar 56 and the wires leading thereto.

Figure 12:
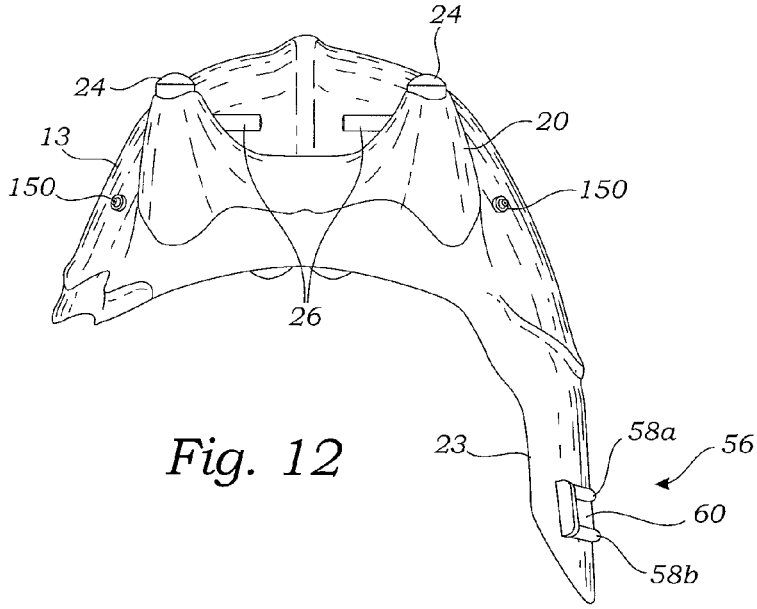
FIG. 12 is a front view of the housing shield of FIG. 9.

FIG. 12 is a front view of the housing shield 13 of FIG. 9. In this view, the extended portion 23 of the housing shield 13 is configured to extend over the outside or lead side of the arm is shown. In the exemplary embodiment shown, this is a left handed housing shield 13. Thus, the extended portion 23 or right side (as viewed from the front) of the housing shield 13 extends downward to protect the outward side of the arm, that being a likely side from which an attack may approach. Terminals 24 and 26 are shown on the arc head 20 and shock bar 56 is shown in the extended portion 23 of the housing shield 13.

Figure 16:
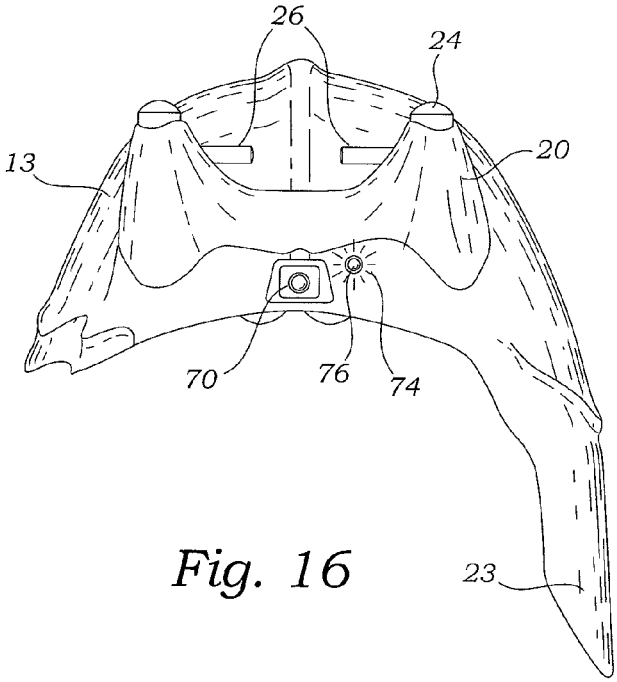
FIG. 16 is a front view of a housing shield including a camera and laser according to another embodiment of the invention.

FIG. 16 is a front view of a housing shield 13 including a camera 70 according to another embodiment of the invention. The camera 70 may include any type of analog or digital imager including, for example, a charge coupled device (CCD) or complimentary metal oxide semiconductor (CMOS) device. The camera 70 is positioned at the front or leading edge of housing shield 13, pointed to focus on an attacker when a user points his hand at the attacker. In one embodiment, the camera 70 generates/records still images. In another embodiment, the camera 70 generates moving or video images. In addition, or in other embodiments, the camera 70 includes audio circuitry configured to capture and/or record conversation or other nearby sounds.

In one embodiment, the user can select when to generate images using the camera 70. For example, when an attack begins, the user wearing the housing shield 23 can take pictures or record video by, for example, removing the disarm pin 6 from the activation port 8 and/or momentarily pressing the trigger button 50. In certain embodiments, a separate switch is provided for taking pictures, and/or recording audio and/or video without the need to arm the stun mechanism. In certain embodiments, momentarily pressing the trigger button 50 delivers an electrical shock and holding down the trigger button 50 for approximately one to two seconds activates the camera 70 or performs other functions such as communicating with a central station or monitoring service, as discussed below. Thus, for example, a user can temporarily generate an electrical arc to frighten a would-be attacker such as a dog without generating video or calling in to a central station or monitoring service.

Figure 17A:
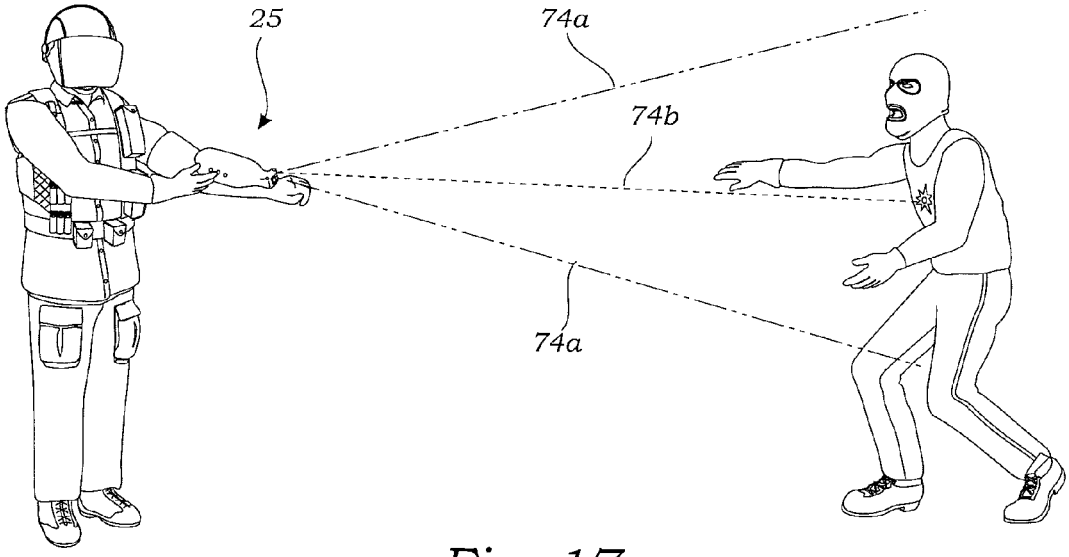
FIG. 17*a* illustrates an exemplary use of the camera and laser in accordance with an embodiment of the invention.
Figure 17B:
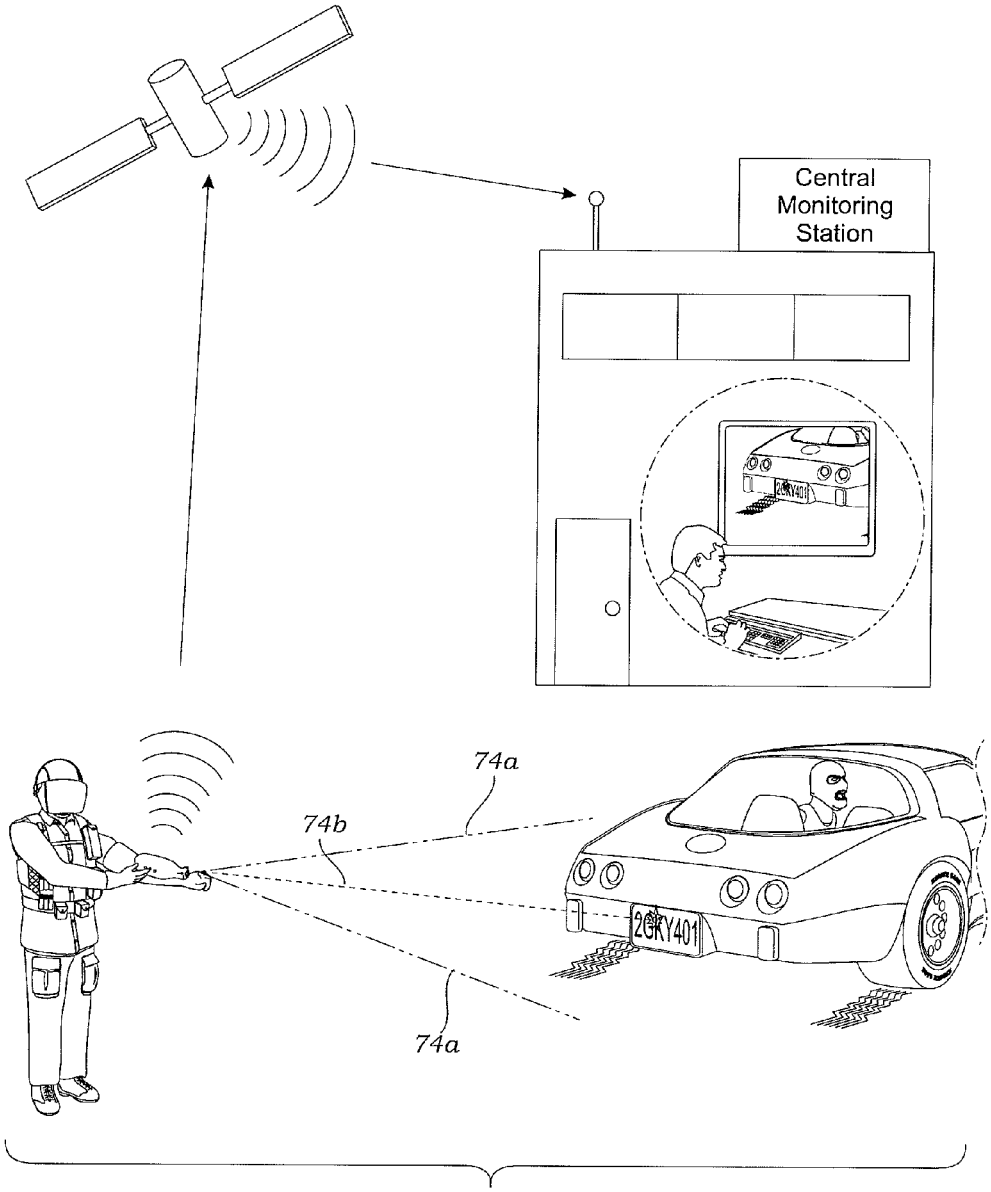
FIG. 17*b* illustrates another exemplary use of the camera and laser in accordance with an embodiment of the invention.

As shown in FIG. 16, in another embodiment, the device includes a laser 74 (two different configurations are shown in the figures, 74*a* and 74*b*) and a laser emitting device 76 that are associated with the camera 70. The camera 70 and laser 74 are placed in alignment such that the camera 70 is recording the general area where the laser 74 is pointing, as shown in FIGS. 17*a* and 17*b*. Therefore, in use, the user points the laser 74 at an object or area to be filmed and the camera 70 then records that area. The camera 70 and laser 74 can be operated by the trigger 50 or may have a separate trigger mechanism for activation thereof. In an embodiment, the camera 70 and laser 74 are automatically operated when the shocking components 24, 26, 56 are activated or are automatically activated after the shocking components have been activated for a predetermined amount of time.

In an embodiment, the laser 74*a* is emitted in a generally conical shape, thereby placing a circle on the object to be filmed and showing the user approximately what area is being filmed. However, this is not a limitation on the present invention. For example, in another embodiment the laser 74*b* may only illuminate a single point. It will be understood that the camera 70 includes an image capture area that it records. The laser 74 is configured so that illuminates at least a portion of the image capture area so that the user knows approximately what is being recorded. The technology for lasers is well known in the art, and therefore will be not describe herein.

FIG. 17*a* illustrates an exemplary use of the personal defense device 25 by a police officer in recording video (and audio) of a criminal according to an embodiment of the invention. In this example, the police officer wearing the device activates the camera and laser and points the laser toward the criminal. With the help of the laser (both a conical laser 74*a* and single point laser 74*b* are shown), the officer knows approximately what the camera is recording (and so does the suspect—thereby causing him to behave) and can then record the best evidence to show the identity of the suspect/attacker. If the laser was not used the officer may not know exactly what the camera is recording.

In another embodiment, the device can include a distress and record mode. In this embodiment, the device can include a panic or distress/secret button that when pressed causes certain components to be activated without any indication. For example, the GPS, camera and communication system may be activated so that the user's location is transmitted to a remote location along with audio and video. That way someone at the remote location can see what's happening without the suspect being alerted to the fact that they're being monitored and recorded. This could be advantageous on a traffic stop where the someone is acting suspicious and the officer does not want to alarm the suspect, but wants to record what is going on and may want back up.

Similar to the embodiment described above without the laser, in a preferred embodiment, the images captured by the camera are transmitted to a remote location, such as a police station, central base, military location, an other officer's car, central monitoring station or the like. Therefore, even if the attacker was to take the device from the user, the images will already have been recorded at a remote location. FIG. 17*b* illustrates this scenario. In this example, the officer points the laser (once again, both a conical laser 74*a* and single point laser 74*b* are shown) at a fleeing suspect's license plate. The image data is transmitted to the central monitoring station and is recorded for later use, as desired (e.g., capturing the suspect, evidence during legal proceedings, etc.) Laser 74*a* does not have to be conically shaped. It can be any desired shape. The image that it projects (border of the illuminated area) can be square, generally round but with a squiggly border, oval, etc. Preferably, this shape will enable the attacker to know they're being recorded.

It will be understood that if the transmission of the image data (which also includes audio data) feature of the device is publicized, attackers will know that the images have already been recorded at a remote location. This may help prevent attacks where the attacker attempts to take the device from the user, therefore preventing further injury to the user and the suspect. Also, if the suspect sees the laser, he/she already knows that they're being filmed and that the evidence against them is mounting.

In certain embodiments of the invention the camera can include the ability to zoom in and zoom out, take still pictures or video and/or audio, can include night vision, and/or infrared viewing or other features known in the video, camera, image capturing arts. Preferably, the camera has a very high resolution (although this is not a limitation and it can be low resolution). High resolution provides better evidence. For example, with the still image of a car, the license plate can be zoomed in on and read. In a low resolution picture the pixilation may make it impossible to read the license plate.

In certain embodiments, still and/or video images are stored in the shield assembly 22. In other embodiments, the shield assembly 22 includes a communication device (not shown) configured to transmit image data and/or audio data to a remote location for storage or further processing. By transmitting the image data to a remote location, reliable evidence can be securely recorded such that it cannot be tampered with by the user or an attacker. Information transmitted to the remote location can be used to identify the user and the attacker and gather other evidence during a confrontation between them.

In one embodiment, the communication device comprises a two-way radio configured to communicate with, for example, a police or military command post. In another embodiment, the communication device comprises a cellular or satellite telephone configured to transmit image data to a central station, for example, to which the user subscribes for security monitoring of the user's use of the shield assembly 22. The central station may be located locally or in another city, state, or country. In one embodiment, the central station offers security monitoring services similar to burglar alarm system monitoring services for residential or business properties. In addition, or in other embodiments, the communication device comprises a laser communication module configured to provide one or two-way communication for secure operations with little or no detection by unauthorized third parties. For example, U.S. Pat. No. 5,801,766, titled "Laser Communication Device," issued Sep. 1, 1998 to Chan et al., which is hereby incorporated herein in its entirety, discloses a portable laser communication transceiver usable by the personal defense device 25. In another embodiment, the device 25 can include a wireless headset or the like (such as a Bluetooth®).

For example, according to one embodiment, the communication device is configured to transmit the image data to the central station for monitoring the use of the shield assembly 22 and for providing appropriate assistance to a registered user of the shield assembly 22. For example, monitoring personnel at the central station may use the information received from the shield assembly 22 to determine whether police, medical, or other emergency assistance is needed at the location of the registered user. In certain embodiments, the communication device also provides one or two-way audio communication between the user and the central station to better evaluate the scene where the user is located, to determine the location of the user, and to provide direct assistance to the user. In one embodiment, the shield assembly 22 comprises a system for communicating with a receiver/processor center as disclosed by U.S. Pat. No. 6,876,302, titled "Non-Lethal Personal Deterrent Device," issued Apr. 5, 2005 to Steeves, which is hereby incorporated herein in its entirety.

Figure 18:
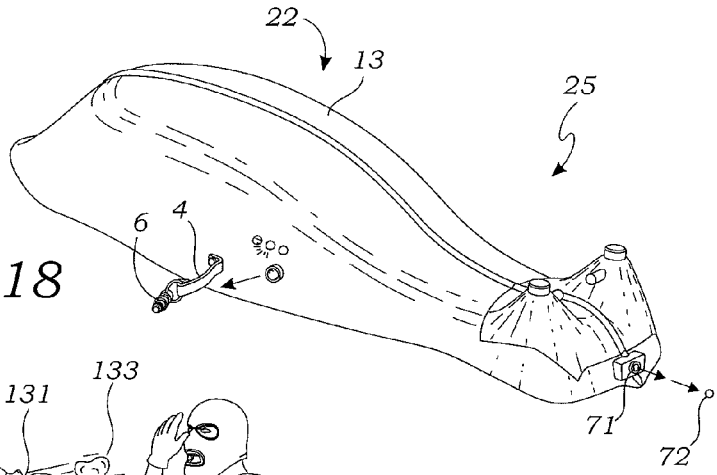
FIG. 18 is a perspective view of a shield assembly including a projectile system.

In one embodiment, a projectile system is incorporated into the housing shield 13. The projectile system may be a mechanical, electrical, or compressed gas projectile system for projecting objects. For example, the projectile system may project pellets, metal balls, bullets, stunning electrodes, pepper spray, or any other defensive projectile. FIG. 18 shows one embodiment of a projectile system. As shown in FIG. 18, shield assembly 22 incorporates a pellet projectile system. Housing shield 13 has nozzle 71 for projecting pellets 72. In one embodiment, housing shield 13 has a $CO_2$ cartridge, which, when activated releases a small spurt of $CO_2$ gas with enough force to project a pellet out of the shield assembly 22 and toward an intended target. Extra pellets 72 may be stored within the shield assembly 22 or outside of the shield assembly 22. As one pellet is projected out of the shield, another pellet is loaded into the projectile system so that another pellet may be projected if needed. In one embodiment, a slingshot system is used by the shield assembly 22 to project a projectile such as a pellet.

Figure 19:
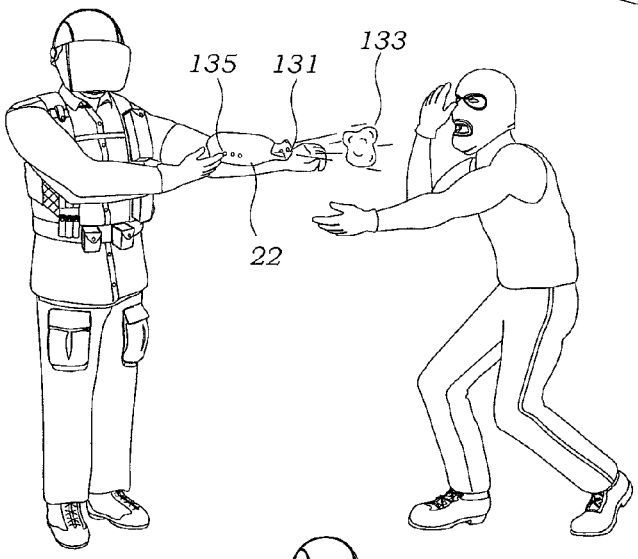
FIG. 19 illustrates a use of the personal defense device by a police officer in subduing an attacker by spraying a solution on the attacker.

In one embodiment, a solution, such as, for example, pepper spray, such as, for example, oleoresin capsicum, or tear gas is projected out of the personal defense device. FIG. 19 illustrates an example of a police officer spraying a solution 133 onto an attacker. A small canister of a solution is stored within the shield assembly 22 and aligned on the same axis as the nozzle 131. When a user, such as a police officer, activates the solution sprayer, such as by pushing button 135, a solution 133 is sprayed out of nozzle 131 at a would be attacker.

Figure 20:
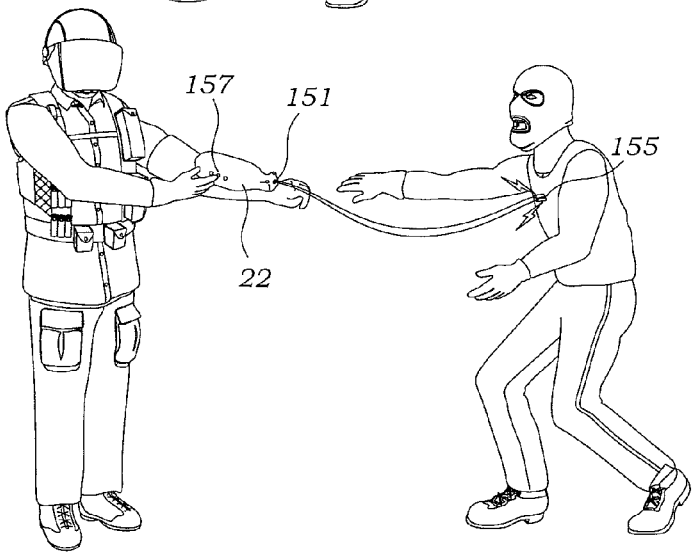
FIG. 20 illustrates a use of the personal defense device by a police officer in subduing an attacker by projecting electrodes at an attacker.

In one embodiment, the projectile system projects electrodes, either attached to electrode wires, or unattached, which subdue an attacker by shocking them. FIG. 20 illustrates an example of a police officer using the personal defense device to project electrodes at an attacker. Shield assembly 22 includes a nozzle 151 for projecting electrodes 155 at an attacker. The user activates the electrodes by pushing a button or pulling an activation switch. The electrodes are then projected out of the shield assembly 22 at an attacker.

The projectile system can be activated through the use of a button either on the shield or through a button on the palm of the hand. In addition, the projectile system can be activated through the use of a switch, a pull tab, a trigger mechanism, or any other appropriate activation mechanisms. In addition, any known projectile systems may be used with the present disclosure, including for example, projectile systems incorporated in guns, pepper spray cans, shocking devices.

Figure 21:
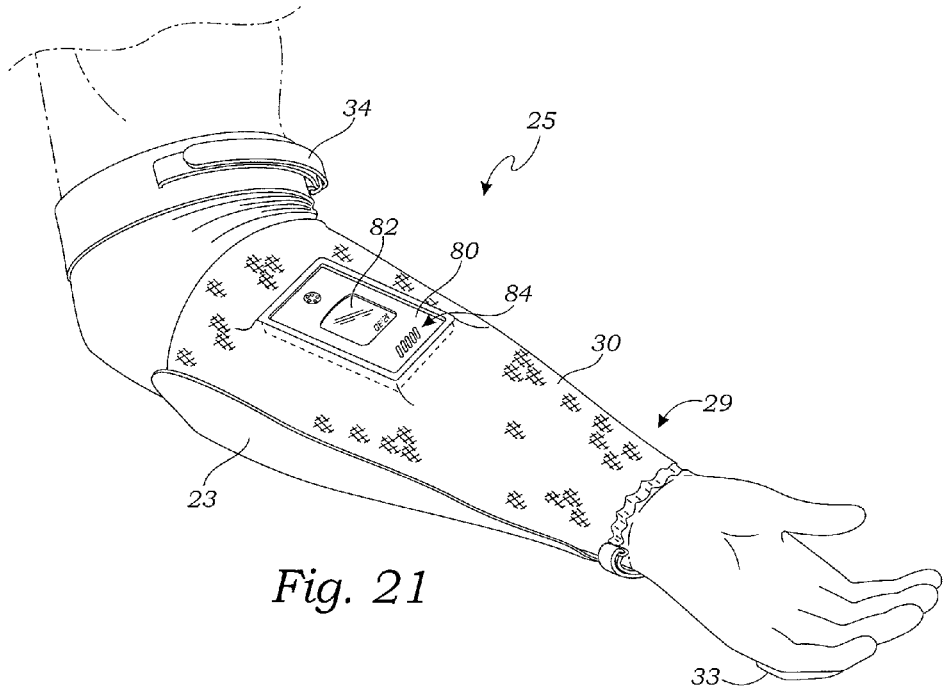
FIG. 21 is a perspective view of the underside of the arm gauntlet of the personal defense device of FIG. 4 including a global positioning unit according to an embodiment of the invention.

FIG. 21 is a perspective view of the underside of the arm gauntlet 30 of the personal defense device 25 of FIG. 4 including a global positioning unit 80 according to an embodiment of the invention. FIG. 21 also illustrates the extended portion 23 of the housing shield covering at least a portion of the side of the user's forearm. In one embodiment, as shown in FIG. 21, the global positioning unit 80 is attached to the underside of the arm gauntlet 30. In certain embodiments, the global positioning unit 80 is positioned at least partially under the housing shield so as to be protected from an attacker. The global positioning unit 80 is configured to determine the user's location by receiving signals from global positioning system (GPS) satellites. The global positioning unit 80 can also be configured to determine the location of images captured by the camera 70. This could help when collecting or using the images as evidence in legal proceedings and the like. In another embodiment, the personal defense device can include a compass that is also in communication with the camera and that records, at the remote location, with the image data, directional data that shows what direction the camera is pointing as it records images.

In one embodiment, the user can use the location information to navigate from place to place. In addition, or in other embodiments (such as the embodiment with the distress button, discussed above), the communication device discussed above is configured to transit the user's location to the command post or central station so emergency assistance can be automatically directed to the user. In certain such embodiments, the communication device is in regular contact with the command post or central station to provide real-time information of the positions of operatives or subscribers wearing the personal defense device 25. Further, when the camera 70 is active, the command post or central station will know of an attack, and can send reinforcements or emergency assistance without the need for a verbal request. This is advantageous to a lone operative, for example, who may not have time to make a verbal request for backup or verbally provide location information.

In addition, or in other embodiments, the global position unit 80 and/or communication device includes a display 82 and input keys 84. In certain such embodiments, the personal defense device 25 is configured to provide internet access and/or other wired or wireless communication including, for example, cellular phone communication or Bluetooth communication. In certain embodiments, two or more personal defense devices 25 can communicate with each other through wired or wireless communication. In one embodiment, the personal defense devices 25 have identification information stored on the devices so that the personal defense device can be identified quickly, by, for example, a police officer or at a security check point. Thus, the personal defense device can be easily identified by authorized personnel. In one embodiment, the personal defense device can be identified, and information stored thereon obtained, by authorized personnel without the user being aware of the communication taking place. In certain embodiments, the display 82 comprises a liquid crystal display (LCD) or other types of displays generally used by, for example, cellular phones or personal digital assistants (PDAs).

Figure 23:
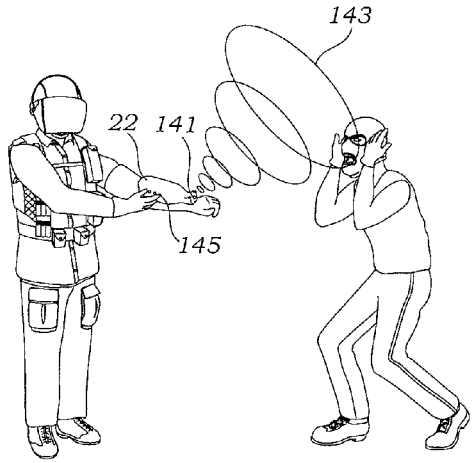
FIG. 23 illustrates a use of the personal defense device by a police officer in subduing an attacker by using a loud noise to stop an attacker.

An artisan will recognize from the disclosure herein that the personal defense device 25 may include a wide variety of devices and/or weapons. For example, the personal defense device 25 may be configured to transmit an electrical charge to an attacker without making physical contact with the attacker. For example, the SunStrike™ device available from Extreme Alternative Defense Systems, LTD. of Anderson, Ind. may be configured for use with the personal defense device 25 to deliver a lightning-like discharge to an attacker. As another example, the personal defense device 25 may be configured to dispense a loud siren noise (such as from an air siren canister) that disorients, frightens and/or renders an attacker helpless. FIG. 23 illustrates an example of a siren noise 143 used to stop an attacker. A police officer, or other user, activates a switch, such as switch 145, which releases a loud noise 143 out of an opening 141 in the shield assembly 22.

Figure 22:
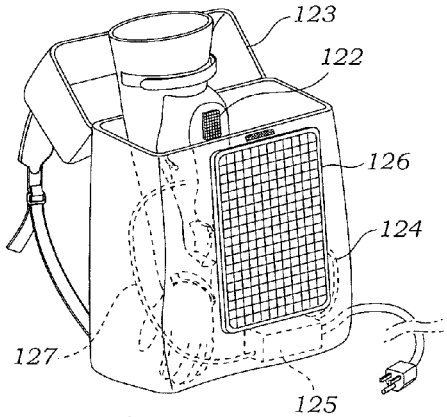
FIG. 22 illustrates an enclosure for storing the personal defense device.

The personal defense device 25 may also include non-weapon devices such as solar panels to recharge the battery pack 10 and/or operate electronic circuitry. FIG. 22 illustrates an embodiment of the personal defense device incorporating solar panels. In some embodiments, solar panels 122 are located on the personal defense device 25. The solar panels can be located on the glove 29 or on the shield assembly 22. In some embodiments, the solar panels are located on a storage enclosure 123, such as, for example, a carrying case or backpack, configured to stow the personal defense device 25 when not in use. Personal defense device storage enclosure 123 has solar panels 126 for charging a battery 125. In one embodiment, the solar panels 126 provide a trickle charger. In one embodiment, the battery 125 also has a cord for plugging into a standard electrical outlet to charge the battery 125. The battery 125 is connectable to the battery 10 through the shield assembly 22 in order to charge the battery pack 10. In one embodiment, the solar panels directly charge the battery pack 10. For example, U.S. Pat. No. 6,870,089, titled "System and Apparatus for Charging an Electronic Device Using Solar Energy," issued Mar. 22, 2005 to Gray, which is hereby incorporated by reference herein in its entirety, discloses a portable apparatus that can be used to charge the battery pack 10 while carrying or attached to the personal defense device 25.

Figure 24:
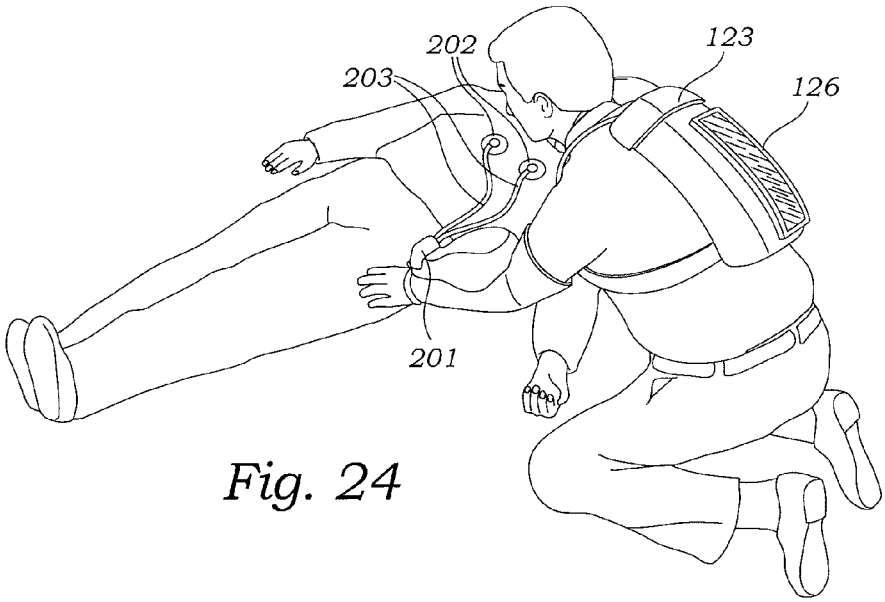
FIG. 24 illustrates using the personal defense device to defibrillate another person.

As another example, the personal defense device 25 may include a defibrillation mode to treat ventricular fibrillation wherein an electric shock can be delivered to a patient to terminate a cardiac arrhythmia in which the patient's heart is unable to pump a significant volume of blood. FIG. 24 illustrates an embodiment of the personal defense device 25 which includes defibrillation electrodes 202 or paddles configured to attach to the arc head 20 through attachment member 201 configured to snap over or otherwise quickly attach to the arc head 20. Arc head 20 releases a charge which is received by attachment member 201 and sent through lines 203 to electrodes 202 which shocks a patient to end a cardiac arrhythmia. In some embodiments, the personal defense device 25 includes defibrillation circuitry and/or ECG detection circuitry as disclosed in U.S. Pat. No. 5,658,316, titled "Portable Defibrillator with Disposable Power Pack," issued Aug. 19, 1997 to Lamond et al., which is hereby incorporated by reference herein in its entirety.

Figure 25:
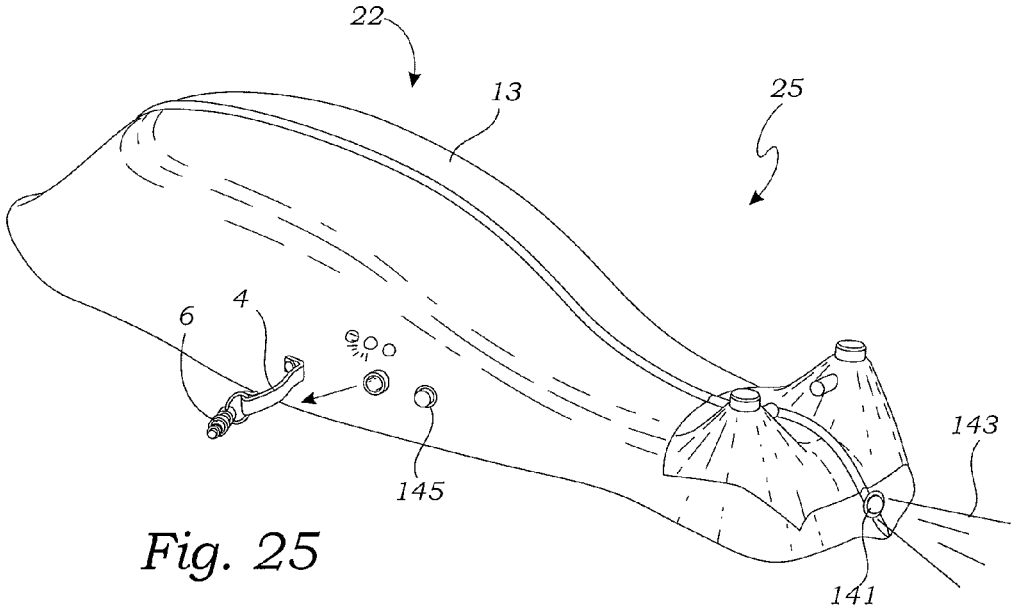
FIG. 25 illustrates is a perspective view of a shield assembly including a light source.

Other examples of non-weapon devices usable by the personal defense device 25 include a glass breaking device, a flashlight (including, for example, a high-intensity discharge lamp, an incandescent light bulb, a light emitting diode, or other light source), or a spring-loaded tool shaft. The spring loaded tool shaft may be configured, for example, to eject a tool or weapon such as a knife from the personal defense device 25. FIG. 25 illustrates an embodiment of the personal defense device including a light source 142. The shield assembly 22 includes a light source 142, such as a flashlight, for projecting light 144. The shield assembly 22 also includes a light source activation button 146 for activating the flashlight.

As another example, the personal defense device 25 according to one embodiment includes a portable metal detector or frisking device such as the portable metal detector disclosed in U.S. Pat. No. 6,211,672, titled "Human Appendage Mounted Metal Detector," issued Apr. 3, 2001 to Bauman et al., which is hereby incorporated by reference herein in its entirety.

Figure 26:
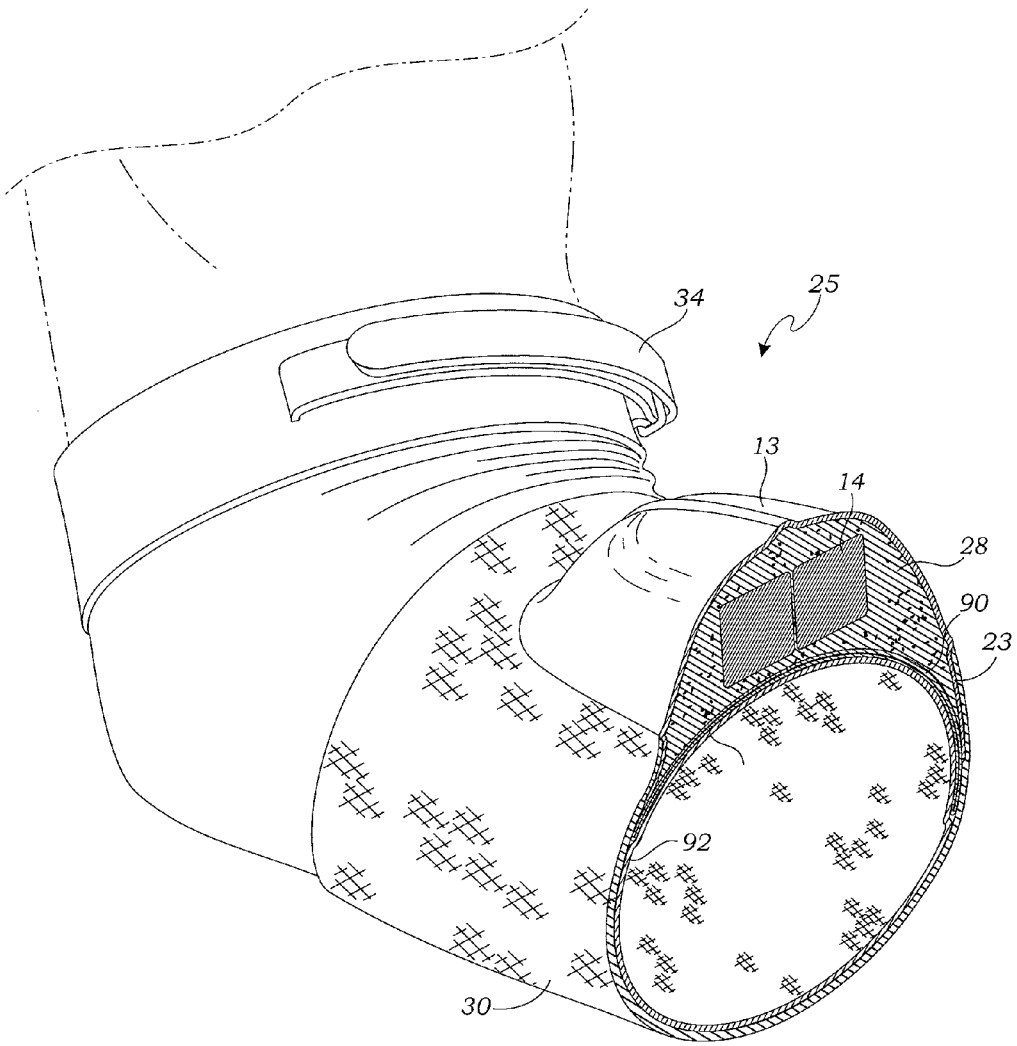
FIG. 26 is a perspective view illustrating a cutaway section of the personal defense device of FIG. 4 according to an embodiment of the invention.

FIG. 26 is a perspective view illustrating a cutaway section of the personal defense device 25 of FIG. 4. As shown in FIG. 26, in certain embodiments, a foam or gel 28 is disposed inside the housing shield 13 along with electronic components (a cross-section of the high voltage module 14 is shown) to stabilize the electronic components underneath the housing shield 13. The gel 28 is configured to absorb and distribute impact forces applied to the housing shield 13 to protect the electronic components and the user's arm. In addition, or in other embodiments, a foam pad 90 beneath the housing shield 13 further absorbs and distributes impact forces to protect the user's arm. In certain embodiments, the arm gauntlet 30 includes a fabric liner 92 configured to separate the user's arm from the housing shield 13 and the outer surface of the arm gauntlet 30. In certain embodiments, the fabric liner 92 comprises a smooth and comfortable material such as lycra. Other suitable materials include, for example, cotton, wool and/or silk.

Figure 27:
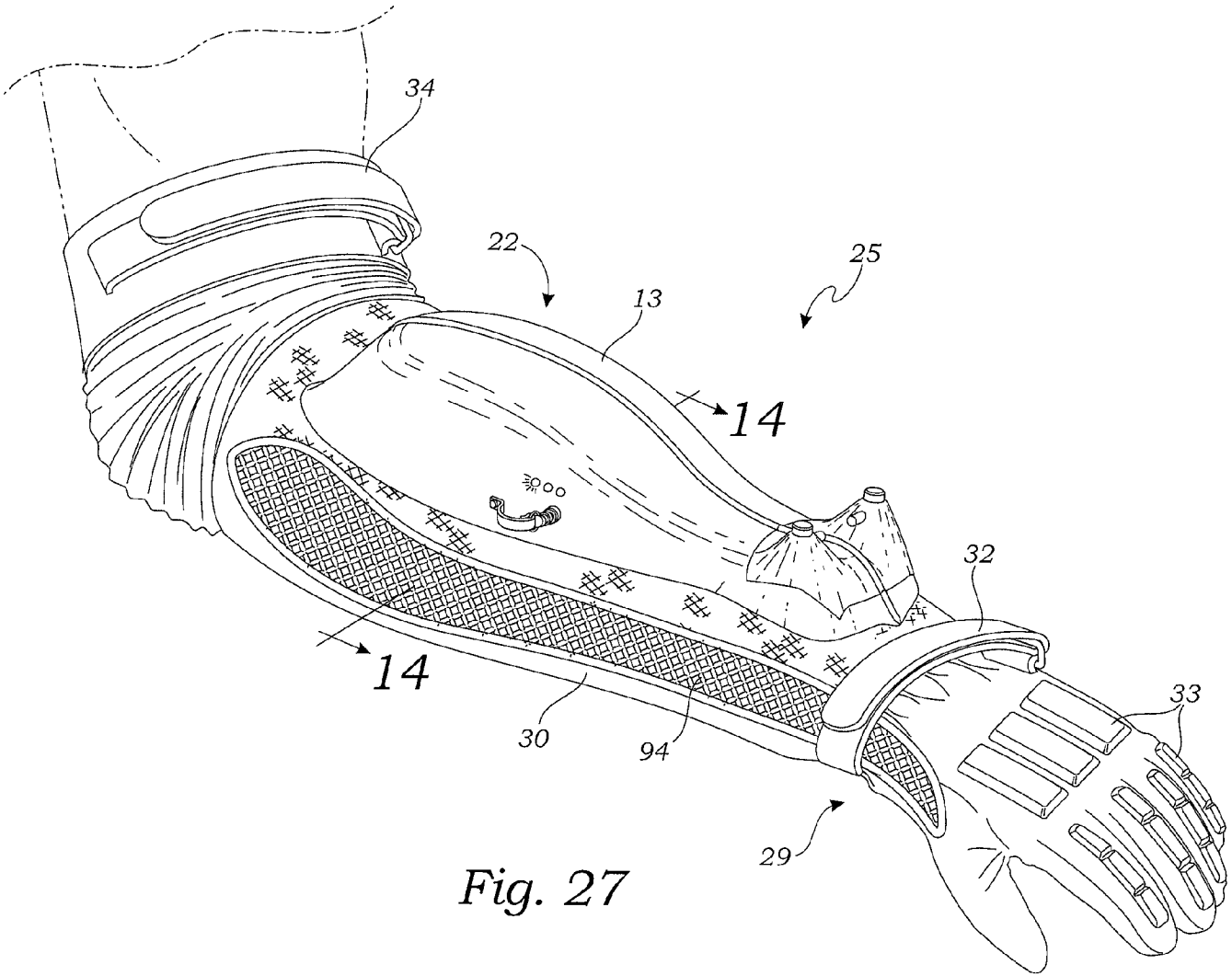
FIG. 27 is a perspective view of the personal defense device of FIG. 4 including a breathable panel in the arm gauntlet area of the glove according to an embodiment of the invention.

FIG. 27 is a perspective view of the personal defense device 25 of FIG. 4 including a breathable panel 94 in the arm gauntlet area 30 of the glove 29 according to an embodiment of the invention. The breathable panel 94 is configured to provide air flow to a user's arm during use and to allow perspiration to evaporate, thus cooling the user's arm and providing increased comfort. In certain embodiments, the breathable panel 94 comprises a mesh or other ventilation material 94. In another embodiment, the device 25 can have a cooling suit ability, similar to cooling suits used by NASA and NASCAR. In one embodiment, the device 25 can include a plurality of cooling bars that can be placed therein and can cool the user's arm and help prevent discomfort. In yet another embodiment, the device 25 can be waterproof so that it can be worn in the water. This could be advantageous for military personnel who need to go in the water or for divers, surfers, swimmers, etc. It can help prevent shark attacks, etc.

Figure 28:
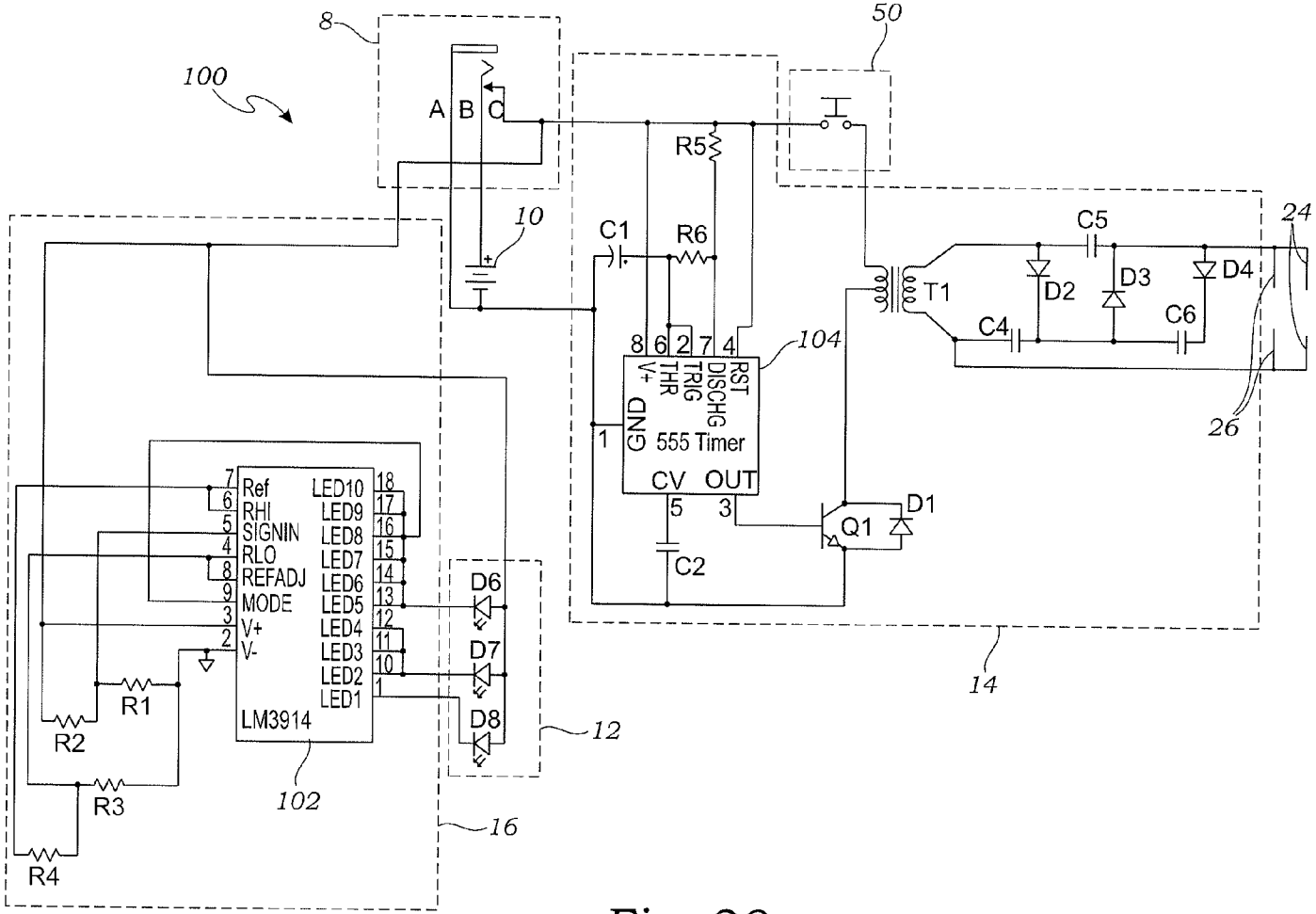
FIG. 28 is a block diagram of electrical circuitry usable by the shield assembly of FIG. 2 according to an embodiment of the invention.
Figure 29:
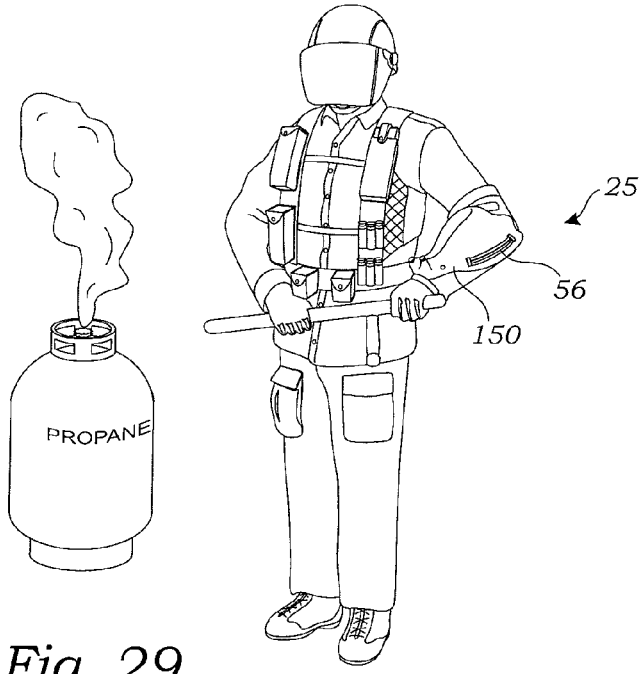
FIG. 29 illustrates a police officer wearing a personal defense device in the presence of a flammable gas.
Figure 30:
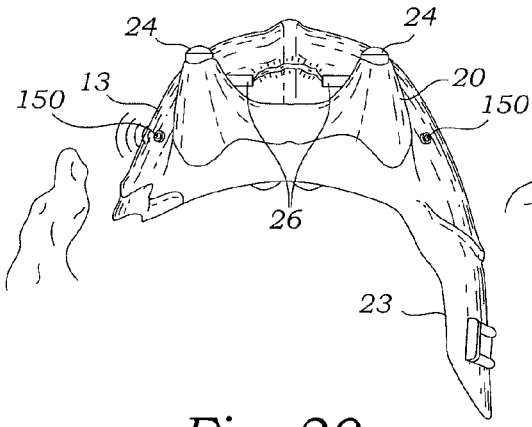
FIG. 30 is a front view of a shield assembly showing the sensor about to sense a flammable gas in accordance with an embodiment of the invention.
Figure 31:
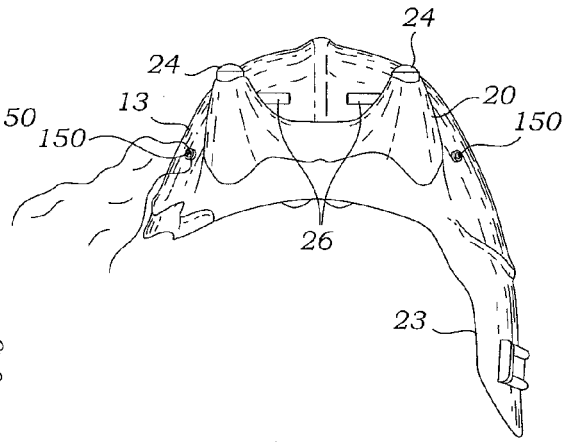
FIG. 31 is a front view of a shield assembly showing the sensor sensing a flammable gas and cutting off the flow of electricity in accordance with an embodiment of the invention.
Figure 32:
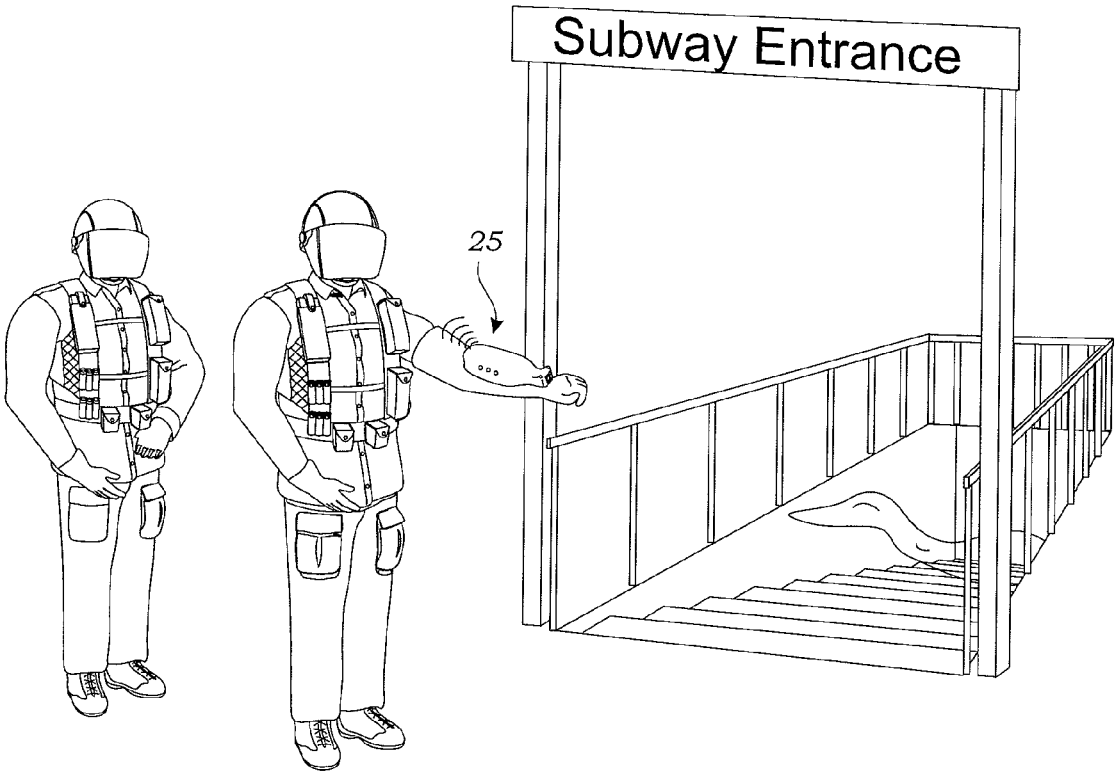
FIG. 32 illustrates a police officer wearing a personal defense device that includes a chemical/gas sensor about to descend into a subway station in the presence of a flammable gas.

FIG. 28 is a block diagram of one embodiment of electrical circuitry 100 usable by the shield assembly 22 of FIG. 2 according to an embodiment of the invention. It is to be understood that any circuitry for delivering a high voltage shock will work with the disclosure of the present invention, and the diagram of FIG. 28 is shown as an example of one circuit and is not shown by way of limitation. The electrical circuitry 100 includes the activation port 8, battery pack 10, LEDs 12, high voltage module 14, battery state indicator module 16, terminals 24, 26 and trigger button 50 discussed above. The activation port 8 includes pins A, B and C used to control connections between the battery pack 10, the trigger button 50 and the battery state indicator module 16 when the disarm pin 6 (see, for example, FIG. 5) or external power charger (not shown) is inserted in the activation port 8.

To charge the battery pack 10, a connector from the external power charger is inserted into the activation port 8 so as to create an electrical path between pin A and pin B. With the external power charger inserted in the activation port 8, pin C is disconnected from pins A and B. The connection between pin A and pin B allows current to flow from the external power charger to the battery pack 10 during a charging cycle. When the disarm pin 6 is inserted into the activation port 8, none of the pins A C are connected to one another. Thus, with the disarm pin 6 inserted, power is not provided from the battery pack 10 to the high voltage module 14 or the battery state indicator module. In this disarmed state, the LEDs are not lit and the user cannot provide a voltage to the terminals 24, 26 and/or shock bar 56 by pressing the trigger button 50.

When neither the disarm pin 6 nor the external power charger are inserted in the activation port 8, pin A is not connected and pin B is connected to pin C. This is the active or live shocking state and the battery pack 10 is electrically connected to the high voltage module 14 and the battery state indicator module 16. As discussed above, in this state the battery state indicator module 16 is configured to measure the relative charge remaining in the battery pack 10 and the high voltage module 14 is configured to convert a relatively low voltage from the battery pack 10 to a relatively high voltage. The relatively high voltage can then be provided to the terminals 24, 26 and/or shock bar 56 when the user presses the trigger button 50.

As discussed above, in an exemplary embodiment, the three LEDs 12 are red, yellow and green. The green light is lit when the battery pack 10 is amply charged, the yellow light is lit when the battery pack 10 needs charging and the red light is lit when the battery pack 10 is critically discharged. If none of the LEDs 12 are lit during the activated state, the battery pack 10 is discharged such that it can provide little or no power and should be recharged or replaced. As discussed above, a single light with multi-colors can also be used.

As shown in FIGS. 9-12 and 29-32, in another embodiment, the personal defense device 25 may include one or more gas/chemical/radiation sensors 150. The sensor 150 can be configured to automatically emit a sound (possibly the siren noise 143) and/or activate a light (the LED's 12, light 141 or other lights) when a gas or chemical is detected (it will be understood that the sensor 150 can be preprogrammed to sense certain or predetermined gases or chemicals). For example, the sensor 150 can be configured such that if a flammable gas is detected, depressing the trigger 50 will not activate the vertical, horizontal electrically conductive terminals 24, 26 or the shock bar 56. This reduces the possibility of an explosion. It will be understood that the sensor 150 can be located anywhere on the personal defense device 25. Any type of sensor can be used. For example, the flammable gas sensor disclosed in U.S. Pat. No. 4,913,792 titled "Flammable-Gas Sensor," issued Apr. 3, 1990 to Nagata et al., which is hereby incorporated by reference herein in its entirety, can be used.

In one embodiment of the invention, the sensor 150 can send a signal to a remote location to notify others what chemical or gas has been detected. That way they can dispatch a hazmat team that knows what they are going to have to deal with. For example, if a deadly chemical gas is present and the user of the device is killed by the gas, others will know to stay out of that location or will be prepared after the sensor has sent a signal to headquarters.

As shown in FIG. 10, in another embodiment, the personal defense device 25 may include a biometric analysis unit 152. The biometric analysis unit 152 can be any unit for determining the identity of a person using biometrics. For example, the unit 152 can be a retinal scanner, fingerprint reader, scanner that identifies someone by reading the veins in their face, DNA analyzer, etc. This allows the wearer to identify a person to determine if they are who they have identified themselves as. It will be understood that the biometric analysis unit can be located anywhere on the personal defense device 25. The unit 152 can be a tissue analyzer, such as that disclosed in U.S. Pat. No. 6,560,352, titled "Apparatus and method of biometric identification or verification of Individuals Using Optical Spectroscopy," issued May 6, 2003 to Rowe et al., which is hereby incorporated by reference herein in its entirety. Or, the unit can be another type of device for determining a biometric characteristic unique to the individual, such as the device taught in U.S. Pat. No. 6,560,352, titled "National identification card system and biometric identity verification method for negotiating transactions," issued Aug. 23, 2005 to Haala, which is hereby incorporated by reference herein in its entirety. The unit 152 can be in electrical communication with a database, such as the National Crime Information Center database or the like. This will allow immediate notification of identity.

In an exemplary embodiment, a police officer wearing the personal defense device 25 can have a suspect place his finger on the biometric analysis unit 152, which then reads the fingerprint and extrapolates identity data therefrom. This identity data is then correlated with a database (that is either stored in memory in the personal defense device 25 or at a remote location) and the suspect's identity is determined. It will be understood that this is only an example, and, from this description, those skilled in the art will understand how other types of biometric analysis can be used.

In another embodiment, the personal defense device can include a DNA analyzer. In an exemplary embodiment, the user could scrape the surface of the suspect's skin, take a swab of the tongue, take a hair sample, etc. and place it in a DNA analysis compartment or the like. The sample can then be analyzed and the identity data can be transmitted both to the user and/or to the central monitoring station or other remote location to verify the identity of the suspect. In another embodiment, the sample can be stored in the compartment for analysis at a later time at a remote location.

Figure 33:
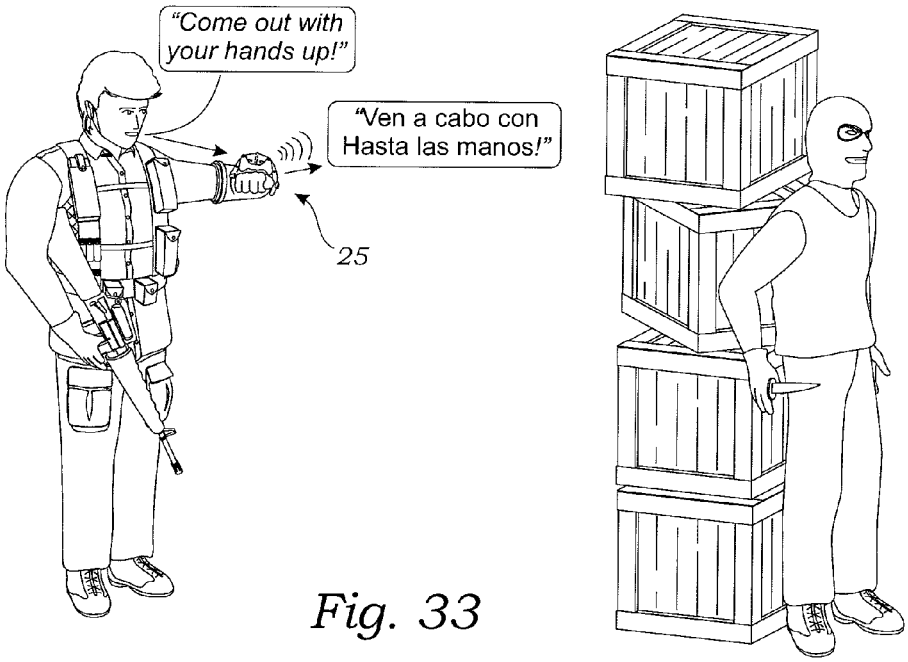
FIGS. 33-34 illustrate a police officer wearing a personal defense device that includes a translator communicating with a Spanish speaking criminal in accordance with an embodiment of the invention.
Figure 34:
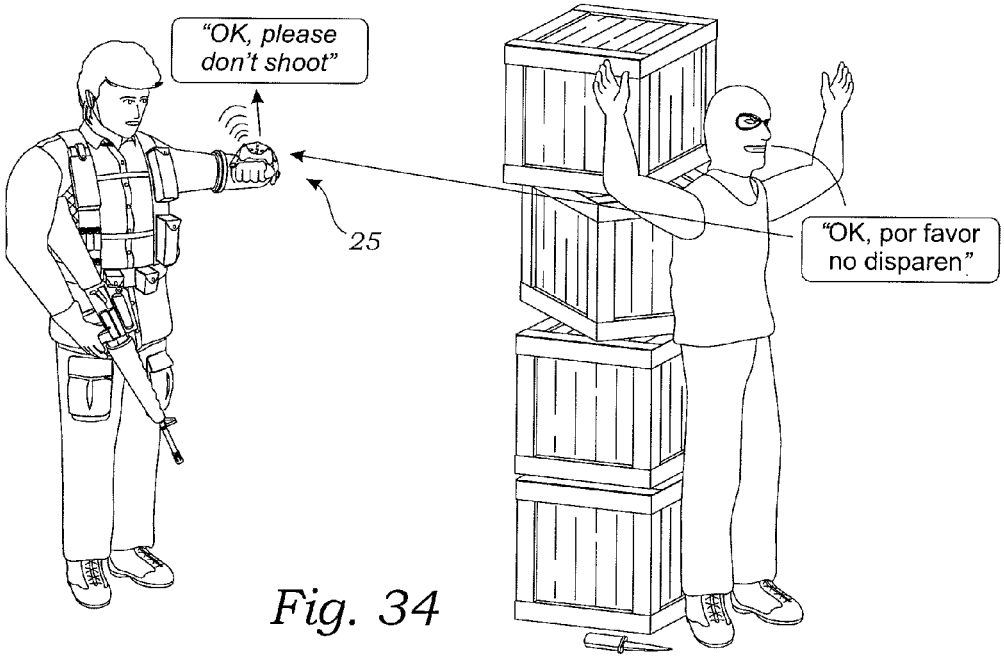

As shown in FIGS. 11 and 33-34, an embodiment of the personal defense device 25 can include a translator 156. The circuitry and components of the translator 156 can be housed inside the housing shield 13 and can include a microphone and speaker. As shown in FIG. 11, the speaker can be mounted on the outside of the housing shield 13. In another embodiment, the speaker can be housed within the housing shield as well. An exemplary translator is taught in U.S. Patent Publication No. 2005/0227637, titled "Universal Translator/Converter," published Oct. 13, 2005 to Clark, which is hereby incorporated by reference herein in its entirety. In another embodiment, the translator may include a display (such as display 82) that prints out the translated text.

FIGS. 33-34 illustrate an exemplary use of the personal defense device 25 by a border patrol agent/police officer in apprehending a Spanish speaking subject according to an embodiment of the invention. In this example, as shown in FIG. 33, the police officer wearing the device speaks "Come out with your hands up!" into the translator 156, which is then translated so that the suspect can understand the phrase in Spanish as "Ven a cabo con hasta las manos!" As shown in FIG. 34, the suspect responds with "OK, por favor, no disparen," which is translated into English as "OK, please don't shoot.".

Figure 35:
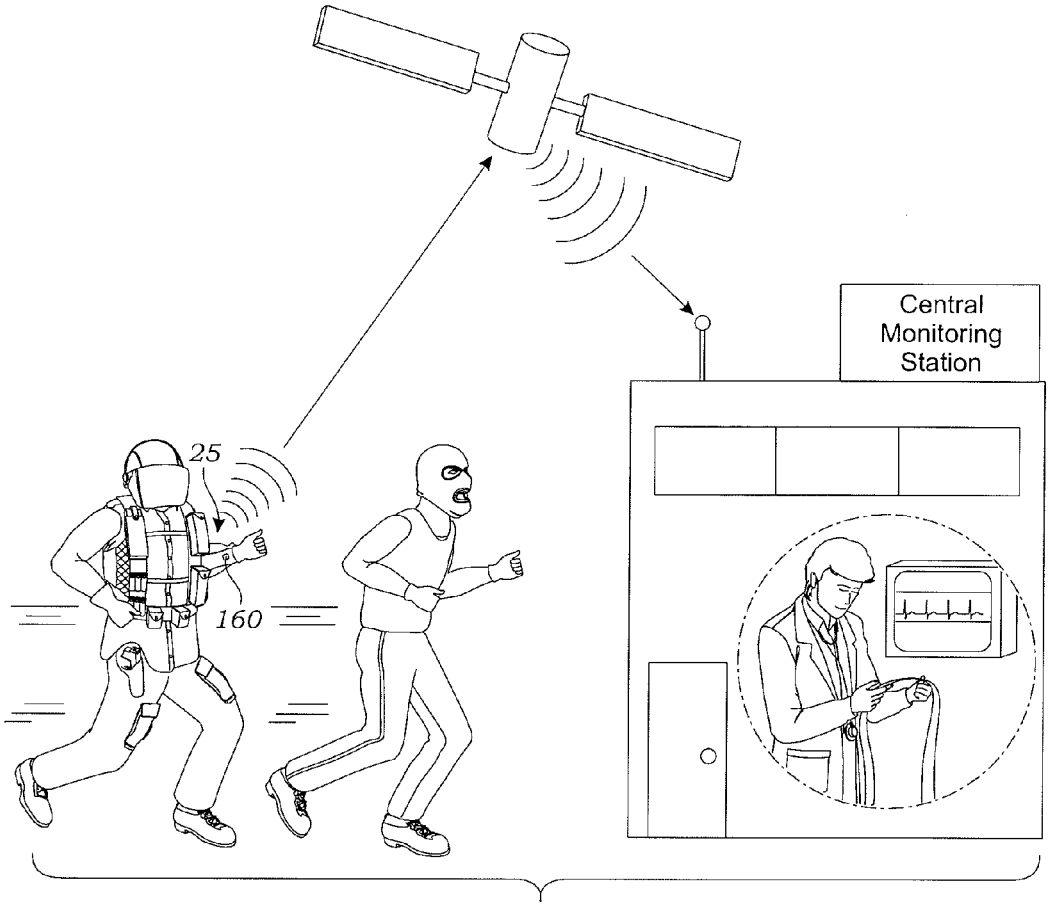
FIG. 35 illustrates a police officer wearing a personal defense device that includes a vital signs monitoring device in accordance with an embodiment of the invention.

As shown in FIGS. 6 and 35, in an embodiment of the invention, the personal defense device can include a vital signs monitor 160, such as a heart monitor. In this embodiment, the vital signs monitor 160 can be any unit for monitoring the vital signs of the user. For example, the monitor 160 can be a pair of electrodes that monitor the heart rate of the user. In another embodiment, the monitor 160 can be a monitor such as the one taught in U.S. Patent Publication No. 2004/0153007 to Harris, et al., titled Physiological Monitoring and System, published on Aug. 5, 2004, the entirety of which is hereby incorporated by reference.

In other embodiments the personal defense device can include other components, such as lie detector software that a police officer or other user can use on the scene to determine if a suspect is being truthful. The personal defense device can also include a hand held metal detector such as the FRISKER or FRISKERPRO, made by Paradigm, Inc. For example, the metal detector can be mounted in the glove.

While certain embodiments of the inventions have been described, these embodiments have been presented by way of example only, and are not intended to limit the scope of the inventions. For example, other non-lethal methods of incapacitating a threat may also be incorporated to the devices of the present disclosure, such as, for example an audio system that incapacitates a would-be attacker. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A personal defense device comprising:

a shield member configured to be worn over at least a third of a length of a user's forearm, the forearm being bounded by the user's ipsilateral wrist and ipsilateral elbow, the length being measured from the wrist to the elbow, the shield member conforming closely to the outer surface contours of a forearm, and a portable source of electricity, wherein the shield member includes an electrical shock bar configured to receive an electrical current from the electrical source and to deliver an electrical shock to a human or other animal, wherein the electrical shock bar includes a pair of substantially parallel shock bar members, and wherein the electrical shock bar is configured to deliver an electrical shock when the electrical shock bar receives an electrical current from the electrical source and both of the shock bar members are contacted simultaneously.

2. The personal defense device of claim 1 wherein the electrical shock bar is substantially flush with an outside surface of the shield member.

3. The personal defense device of claim 1 wherein the pair of shock bar members are separated by an insulator.

4. The personal defense device of claim 1 further comprising a plurality of electrical terminals extending outwardly from the shield member, the terminals configured to receive an electrical current from the electrical source, wherein a first pair of the plurality of electrical terminals is configured to deliver an electrical shock to a human or other animal.

5. A personal defense device comprising:

a shield member configured to be worn over at least a third of a length of a user's forearm, the forearm being bounded by the user's ipsilateral wrist and ipsilateral elbow, the length being measured from the wrist to the elbow, the shield member conforming closely to the outer surface contours of a forearm, and a portable source of electricity, wherein the shield member includes an electrical shock bar configured to receive an electrical current from the electrical source and to deliver an electrical shock to a human or other animal, wherein the electrical shock bar includes a pair of substantially parallel shock bar members, wherein the shield member has a length and wherein the electrical shock bar extends along over at least a third of the length of the shield member.

6. The personal defense device of claim 1 further comprising an imaging device, wherein the imaging device includes an image capture area, and a laser emitting device in alignment with the imaging device, wherein the laser illuminates at least a portion of the image capture area.

7. The personal defense device of claim 1, wherein the electrical circuitry is configured to convert a first voltage level to a second voltage level and to provide the second level to at least the electrical shock bar.

8. The personal defense device of claim 1, further comprising a pair of terminals configured to generate a spark, wherein the spark generates an electric current arcing noise.

9. The personal defense device of claim 4, wherein the plurality of electrical terminals are part of the same circuit as the electrical shock bar.

10. The personal defense device of claim 9, further comprising a trigger attached to the glove, the trigger being user selectable to deliver a voltage to the plurality of electrical terminals and the electrical shock bar.

11. A personal defense device comprising:

a shield member configured to be worn over at least a third of a length of a user's forearm, the forearm being bounded by the user's ipsilateral wrist and ipsilateral elbow, the length being measured from the wrist to the elbow, the shield member conforming closely to the outer surface contours of a forearm, a portable source of electricity, and a sensor for sensing predetermined gases and/or chemicals, wherein the shield member includes an electrical shock bar configured to receive an electrical current from the electrical source and to deliver an electrical shock to a human or other animal.

12. The personal defense device of claim 11 wherein the sensor is configured to prevent electricity from flowing through the electrical circuit if a predetermined gas/chemical is sensed.

13. The personal defense device of claim 1 further comprising a biometric analysis unit.

14. The personal defense device of claim 1 further comprising a translator.

15. The personal defense device of claim 1 further comprising at least one component selected from the group consisting of a translator, a biometric analysis unit, a global positioning device, a lie detector, a metal detector, a gas/chemical sensor, a camera, a laser emitting device, a vital signs monitor, a siren, a defibrillator, a two-way radio, a projectile system, a wireless headset and a telephone.

16. A personal defense device comprising:

a shield member configured to be worn over at least a third of a length of a user's forearm, the forearm being bounded by the user's ipsilateral wrist and ipsilateral elbow, the length being measured from the wrist to the elbow, the shield member conforming closely to the outer surface counters of a forearm, a portable source of electricity, an imaging device, wherein the imaging device includes an image capture area, and a laser emitting device in alignment with the imaging device, wherein the laser illuminates at least a portion of the image capture area.

17. The personal defense device of claim 16 wherein the shield member includes an electrical shock bar configured to receive an electrical current from the electrical source and to deliver an electrical shock to a human or other animal.

18. The personal defense device of claim 17 further comprising a plurality of electrical terminals extending outwardly from the shield member, the terminals configured to receive an electrical current from the electrical source and being part of the same circuit as the electrical shock bar, wherein a first pair of the plurality of electrical terminals is configured to deliver an electrical shock to a human or other animal.

19. The personal defense device of claim 17 wherein the personal defense device is configured to transmit image data from the imaging device to a receiving station, the receiving station configured to receive and display the image data, and the personal defense device further comprising a global positioning device in electrical communication with the imaging device, wherein the global positioning device is configured to transmit position data from the global positioning device to the receiving station such that the location of the image capture area can be determined.

20. A method comprising the steps of:

providing a personal defense device comprising:

a shield member configured to be worn over at least a third of a length of a user's forearm, the forearm being bounded by the user's ipsilateral wrist and ipsilateral elbow, the length being measured from the wrist to the elbow, the shield member conforming closely to the outer surface counters of a forearm, a portable source of electricity, an imaging device, and a laser emitting device in alignment with the imaging device, illuminating an area with the laser, and recording the illuminated area with the image capture device.

21. The method of claim 20 wherein the personal defense device is configured to transmit image data from the imaging device to a receiving station, wherein the image data includes the illuminated area, and wherein the receiving station is configured to receive and display the image data.

22. The method of claim 20 wherein the shield member includes an electrical shock bar configured to receive an electrical current from the electrical source and to deliver an electrical shock to a human or other animal.

23. A personal defense device comprising:

a shield member configured to be worn over at least a third of a length of a user's forearm, the forearm being bounded by the user's ipsilateral wrist and ipsilateral elbow, the length being measured from the wrist to the elbow; the shield member conforming closely to the outer surface contours of a forearm;

a portable source of electricity;

a plurality of electrical terminals extending outwardly from the shield member; the terminals configured to receive an electrical current from the electrical source, wherein a first pair of said plurality of electrical terminals is configured to deliver an electrical shock to a human or other animal; and a sensor for sensing predetermined gases and/or chemicals, wherein the sensor is configured to prevent electricity from flowing through the electrical circuit if a predetermined gas/chemical is sensed.

* * * * *